US006809480B2

(12) United States Patent
Shino

(10) Patent No.: US 6,809,480 B2
(45) Date of Patent: Oct. 26, 2004

(54) ELECTRON-BEAM APPARATUS AND IMAGE FORMING APPARATUS

(75) Inventor: Kenji Shino, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 179 days.

(21) Appl. No.: 10/107,479

(22) Filed: Mar. 28, 2002

(65) Prior Publication Data

US 2002/0101180 A1 Aug. 1, 2002

Related U.S. Application Data

(62) Division of application No. 09/512,364, filed on Feb. 24, 2000, now Pat. No. 6,404,135.

(30) Foreign Application Priority Data

Feb. 24, 1999 (JP) ..... 11-047170
Jan. 7, 2000 (JP) ..... 2000-001414
Feb. 22, 2000 (JP) ..... 2000-044964

(51) Int. Cl.[7] ..... H09G 3/10
(52) U.S. Cl. ..... 315/169.1; 315/169.3; 345/211; 345/76
(58) Field of Search ..... 315/169.1, 169.3; 345/211, 204, 36, 55, 76, 77

(56) References Cited

U.S. PATENT DOCUMENTS 4,020,280 A 4/1977 Kaneko et al. ..... 358/242
4,031,474 A * 6/1977 Ehni et al. ..... 455/158.2
4,904,895 A 2/1990 Tsukamoto et al. ..... 313/336
5,045,759 A 9/1991 Ye et al. ..... 315/171
5,066,883 A 11/1991 Yoshioka et al. ..... 313/309
5,099,178 A 3/1992 Bozzer et al. ..... 315/169.1
5,569,974 A 10/1996 Morikawa et al. ..... 313/310
5,642,268 A 6/1997 Pratt et al. ..... 363/17
5,659,329 A * 8/1997 Yamanobe et al. ..... 345/74.1
5,682,085 A 10/1997 Suzuki et al. ..... 316/169.1
5,757,630 A 5/1998 Lesea ..... 363/39

(List continued on next page.)

FOREIGN PATENT DOCUMENTS

JP A64-31332 2/1989
JP A2-257551 10/1990
JP A3-55738 3/1991
JP A4-28137 1/1992

OTHER PUBLICATIONS

R. Meyer et al., "Recent Development on Microtips Display at LETI", Tech. Digest of 4th Int. Vacuum Microelectronics Conf., Nagahama, pp. 6–9.
C.A. Spindt et al., "Physical Properties of Thin Films of Thin–film Field Emission Cathodes with Molybdenum Cones", J. Applied Physics, vol. 47, No. 12, Dec. 1976, pp. 5248–5263.
C.A. Mead, "Operation of Tunnel–Emission Devices," J. Applied Physics, vol. 32, No. 4, Apr. 1961, pp. 646–652.

(List continued on next page.)

*Primary Examiner*—Wilson Lee
*Assistant Examiner*—Thuy Vinh Tran
(74) *Attorney, Agent, or Firm*—Fitzpatrick, Cella, Harper & Scinto

(57) ABSTRACT

Even if an output voltage from a high-voltage power source includes a ripple, this invention reduces the influence on a luminance output and suppresses the capacitances of a high-voltage power source transformer and smoothing capacitor. An electron-beam apparatus adopts line-sequential driving of allowing a plurality of electron-emitting devices to simultaneously emit electrons in an arrangement in which an accelerating potential for accelerating electrons includes a ripple. At the same time, sets of devices allowed to simultaneously emit electrons are sequentially switched. The frequency of the ripple is synchronized with the selection frequency of line-sequential driving.

12 Claims, 21 Drawing Sheets

U.S. PATENT DOCUMENTS

| | | | | |
|---|---|---|---|---|
| 5,773,937 | A | 6/1998 | Miyazaki et al. | 315/246 |
| 5,789,871 | A | 8/1998 | Shen et al. | 315/291 |
| 5,866,988 | A | 2/1999 | Oda | 315/169.1 |
| 5,917,290 | A | 6/1999 | Shen et al. | 315/209 R |
| 6,005,540 | A | 12/1999 | Shinjo et al. | 345/74 |
| 6,294,876 | B1 | 9/2001 | Ando et al. | 315/169.1 |
| 6,336,836 | B1 * | 1/2002 | Suzuki et al. | 445/6 |

OTHER PUBLICATIONS

W.P. Dyke et al., "Field Emission", Advances in Electronics and Electron Physics, vol. 8, 1956, pp. 89–185.

M. Elinson et al., "The Emission of Hot Electrons and the Field Emissions of Electrons From Tin Oxide", Radio Engineering and Electronic Physics, Jul. 1965, pp. 1290–1298.

G. Dittmer, "Electrical Conduction and Electron Emission of Discontinuous Thin Films", Thin Solid Films, 9, 1972 pp. 317–328.

M. Hartwell et al., "Strong Electron Emission from Patterned Tin–Indium Oxide Films", IEDM, 1975, pp. 519–521.

H. Araki et al., "Electroforming and Electron Emission of Carbon Thin Films", Journal of the Vacuum Soc. of Japan, vol. 2–6, No. 1, 1983, pp. 22–29 (with English Abstract on p. 22).

* cited by examiner

PWM GRAY LEVEL DRIVING WHEN Va INCLUDES RIPPLE

PWM GRAY LEVEL DRIVING WHEN Va INCLUDES RIPPLE 2

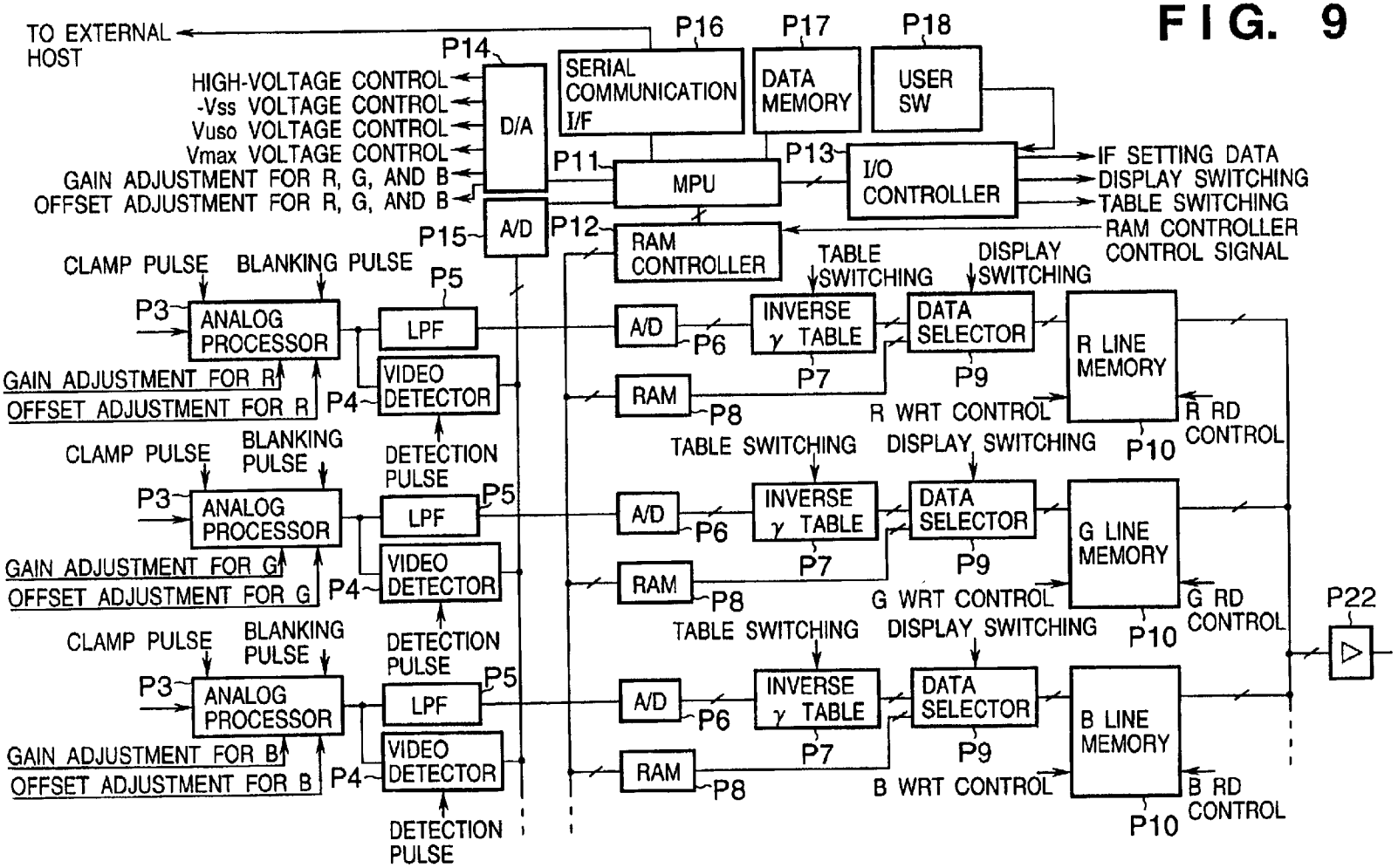
FIG. 9
TO EXTERNAL HOST
SERIAL COMMUNICATION I/F
P16
DATA MEMORY
P17
USER SW
P18
MPU
P11
I/O CONTROLLER
P13
IF SETTING DATA
DISPLAY SWITCHING
TABLE SWITCHING
RAM CONTROLLER CONTROL SIGNAL
D/A
P14
A/D
P15
HIGH-VOLTAGE CONTROL
-Vss VOLTAGE CONTROL
Vuso VOLTAGE CONTROL
Vmax VOLTAGE CONTROL
GAIN ADJUSTMENT FOR R, G, AND B
OFFSET ADJUSTMENT FOR R, G, AND B
RAM CONTROLLER
P12
DISPLAY SWITCHING
TABLE SWITCHING
DATA SELECTOR
P9
INVERSE γ TABLE
P7
A/D
P6
RAM
P8
R WRT CONTROL
R LINE MEMORY
P10
R RD CONTROL
G WRT CONTROL
G LINE MEMORY
G RD CONTROL
B WRT CONTROL
B LINE MEMORY
B RD CONTROL
P22
LPF
P5
VIDEO DETECTOR
P4
DETECTION PULSE
BLANKING PULSE
CLAMP PULSE
ANALOG PROCESSOR
P3
GAIN ADJUSTMENT FOR R
OFFSET ADJUSTMENT FOR R
GAIN ADJUSTMENT FOR G
OFFSET ADJUSTMENT FOR G
GAIN ADJUSTMENT FOR B
OFFSET ADJUSTMENT FOR B PWM GRAY LEVEL DRIVING WHEN Va INCLUDES RIPPLE 2

PRIOR ART

PRIOR ART

ELECTRON-BEAM APPARATUS AND IMAGE FORMING APPARATUS

This application is a division of application Ser. No. 09/512,364, filed Feb. 24, 2000, which is now U.S. Pat. No. 6,404,135.

FIELD OF THE INVENTION

The present invention relates to an electron-beam apparatus and image forming apparatus and, more particularly, to an electron-beam apparatus and image display apparatus for accelerating, at an accelerating potential, electrons emitted by an electron-emitting device.

BACKGROUND OF THE INVENTION

Conventionally, two types of devices, namely thermionic and cold cathode devices, are known as electron-emitting devices. Known examples of the cold cathode devices are surface-conduction emission type electron-emitting devices, field emission type electron-emitting devices (to be referred to as FE type electron-emitting devices hereinafter), and metal/insulator/metal type electron-emitting devices (to be referred to as MIM type electron-emitting devices hereinafter).

A known example of the surface-conduction emission type electron-emitting devices is described in, e.g., M. I. Elinson, "Radio E-ng. Electron Phys., 10, 1290 (1965) and other examples will be described later. The surface-conduction emission type electron-emitting device utilizes the phenomenon that electrons are emitted by a small-area thin film formed on a substrate by flowing a current parallel through the film surface. The surface-conduction emission type electron-emitting device includes electron-emitting devices using an Au thin film [G. Dittmer, "Thin Solid Films", 9,317 (1972)], an $In_2O_3/SnO_2$ thin film [M. Hartwell and C. G. Fonstad, "IEEE Trans. ED Conf.", 519 (1975)], a carbon thin film [Hisashi Araki et al., "Vacuum", Vol. 26, No. 1, p. 22 (1983)], and the like, in addition to an $SnO_2$ thin film according to Elinson mentioned above.

FIG. 17 is a plan view showing the surface-conduction emission type electron-emitting device by M. Hartwell et al. Referring to FIG. 17, reference numeral 3001 denotes a substrate; and 3004, a conductive thin film made of a metal oxide formed by sputtering. This conductive thin film 3004 has an H-shaped pattern, as shown in FIG. 17. An electron-emitting portion 3005 is formed by performing electrification processing (referred to as forming processing to be described later) with respect to the conductive thin film 3004. An interval L in FIG. 17 is set to 0.5 to 1 mm, and a width W is set to 0.1 mm. The electron-emitting portion 3005 is shown in a rectangular shape at the center of the conductive thin film 3004 for the sake of illustrative convenience. However, this does not exactly show the actual position and shape of the electron-emitting portion. In the above surface-conduction emission type electron-emitting devices by M. Hartwell et al. and the like, typically the electron-emitting portion 3005 is formed by performing electrification processing called forming processing for the conductive thin film 3004 before electron emission. In forming processing, a constant DC voltage or a DC voltage which increases at a very low rate of, e.g., 1 V/min is applied across the conductive thin film 3004 to partially destroy or deform the conductive thin film 3004, thereby forming the electron-emitting portion 3005 with an electrically high resistance. Note that the destroyed or deformed part of the conductive thin film 3004 has a fissure. Upon application of an appropriate voltage to the conductive thin film 3004 after forming processing, electrons are emitted near the fissure.

Known examples of the FE type electron-emitting devices are described in W. P. Dyke and W. W. Dolan, "Field emission", Advance in Electron Physics, 8, 89 (1956) and C. A. Spindt, "Physical properties of thin-film field emission cathodes with molybdenium cones", J. Appl. Phys., 47, 5248 (1976).

FIG. 18 is a sectional view showing the FE type device by C. A. Spindt et al. In FIG. 18, reference numeral 3010 denotes a substrate; 3011, an emitter wiring made of a conductive material; 3012, an emitter cone; 3013, an insulating layer; and 3014, a gate electrode. In this device, a voltage is applied between the emitter cone 3012 and gate electrode 3014 to emit electrons from the distal end portion of the emitter cone 3012. As another FE type device structure, there is an example in which an emitter and gate electrode are arranged on a substrate to be almost parallel to the surface of the substrate, in addition to the multilayered structure of FIG. 17.

A known example of the MIM type electron-emitting devices is described in C. A. Mead, "Operation of Tunnel-Emission Devices", J. Appl. Phys., 32,646 (1961).

FIG. 19 is a sectional view showing a typical example of the MIM type device structure. In FIG. 19, reference numeral 3020 denotes a substrate; 3021, a lower electrode made of a metal; 3022, a thin insulating layer having a thickness of about 100 Å; and 3023, an upper electrode made of a metal and having a thickness of about 80 to 300 Å. In the MIM type electron-emitting device, an appropriate voltage is applied between the upper and lower electrodes 3023 and 3021 to emit electrons from the surface of the upper electrode 3023.

Since the above-described cold cathode devices can emit electrons at a temperature lower than that for thermionic cathode devices, they do not require any heater. The cold cathode device has a structure simpler than that of the thermionic cathode device and can shrink in feature size. Even if a large number of devices are arranged on a substrate at a high density, problems such as heat fusion of the substrate hardly arise. In addition, the response speed of the cold cathode device is high, while the response speed of the thermionic cathode device is low because thermionic cathode device operates upon heating by a heater. For this reason, applications of the cold cathode devices have enthusiastically been studied.

Of cold cathode devices, the surface-conduction emission type electron-emitting devices have a simple structure and can be easily manufactured, and thus many devices can be formed on a wide area. As disclosed in Japanese Patent Laid-Open No. 64-31332 filed by the assignee of the present applicant, a method of arranging and driving a lot of devices has been studied.

Regarding applications of the surface-conduction emission type electron-emitting devices to, e.g., image forming apparatuses such as an image display apparatus and image recording apparatus, charge beam sources, and the like have been studied. Particularly as an application to image display apparatuses, as disclosed in the U.S. Pat. No. 5,066,883 and Japanese Patent Laid-Open Nos. 2-257551 and 4-28137 filed by the assignee of the present applicant, an image display apparatus using a combination of a surface-conduction emission type electron-emitting device and a fluorescent substance which emits light upon irradiation of an electron beam has been studied. This type of image display apparatus using a combination of the surface-conduction emission type electron-emitting device and fluorescent substance is expected to exhibit more excellent characteristics than other conventional image display apparatuses. For example, compared with recent popular liquid crystal display apparatuses, the above display apparatus is superior in that it does not require any backlight because it is of a self-emission type and that it has a wide view angle.

A method of driving a plurality of FE type electron-emitting devices arranged side by side is disclosed in, e.g., U.S. Pat. No. 4,904,895 filed by the assignee of the present applicant. As a known example of an application of FE type electron-emitting devices to an image display apparatus is a flat panel display reported by R. Meyer et al. [R. Meyer: "Recent Development on Microtips Display at LETI", Tech. Digest of 4th Int. Vacuum Microelectronics Conf., Nagahama, pp. 6–9 (1991)].

An application of a larger number of MIM type electron-emitting devices arranged side by side to an image display apparatus is disclosed in Japanese Patent Laid-Open No. 3-55738 filed by the assignee of the present applicant.

Several types of cold cathode electron sources have been described above. There is known another structure using an anode electrode for attracting an electron beam from the electron source of a cold cathode device.

Further, there is known a method of supplying, from a switching type high-voltage power source, an accelerating potential for accelerating electrons from an electron source. For example, a CRT uses a flyback type switching power source. An output potential from the switching type high-voltage power source includes an AC component (to be also referred to as a ripple hereinafter). To reduce this ripple, a smoothing circuit may be used, which increases the cost and size. Particularly, a general high-voltage power source uses a high-cost, large-volume capacitor, and the use of a satisfactory smoothing circuit increases the cost and size. Even with the use of the smoothing circuit, a ripple must be permitted to a certain degree in order to reduce the cost or suppress an increase in size.

SUMMARY OF THE INVENTION

It is an object of the present invention to realize a preferable image display apparatus and, more particularly, a preferable structure in a case in which an accelerating potential for accelerating electrons from an electron-emitting device includes an AC component.

One aspect of the present invention comprises the following arrangement.

An electron-beam apparatus comprises an electron source having a plurality of sets each including a plurality of electron-emitting devices, each set being periodically selected, and the plurality of electron-emitting devices in each set being selected and allowed to simultaneously emit electrons, an accelerating electrode for receiving a potential for accelerating electrons emitted by the electron-emitting device, and a power source having an output potential including an AC component, a frequency of the AC component being controlled to be equal to a selection frequency for each set in the electron source, and the output potential being supplied to the accelerating electrode.

In this specification, "the output potential includes an AC component" means that the value periodically varies.

Another aspect of the present invention comprises the following arrangement.

An electron-beam apparatus comprises an electron source having a plurality of sets each including a plurality of electron-emitting devices, each set being periodically selected, and the plurality of electron-emitting devices in each set being selected and allowed to simultaneously emit electrons, an accelerating electrode for receiving a potential for accelerating electrons emitted by the electron-emitting device, and a power source having an output potential including an AC component, a frequency of the AC component being controlled to be equal to a multiple of an integer of not less than 2 of a selection frequency for each set in the electron source, and the output potential being supplied to the accelerating electrode.

Still another aspect of the present invention comprises the following arrangement.

An electron-beam apparatus comprises an electron source having a plurality of sets each including a plurality of electron-emitting devices, each set being periodically selected at a frequency f2, and the plurality of electron-emitting devices in each set being selected and allowed to simultaneously emit electrons, an accelerating electrode for receiving a potential for accelerating electrons emitted by the electron-emitting device, and a power source having an output potential including an AC component, letting q be at least any natural number of 1 to 10, a frequency f1 of the AC component being controlled to satisfy equation (1), and the output potential being supplied to the accelerating electrode, $$f1=n/(q*T) \quad (1)$$

Where n is an arbitrary natural number, and T is a period from time at which any one of the electron-emitting devices is selected and allowed to emit electrons to time at which the electron-emitting devices is selected again and allowed to emit electrons.

In this case, the frequency f1 satisfies equation (1) preferably when q is any natural number of 1 to 5, more preferably when q is any natural number of 1 to 3, and still more preferably when q is 1. The frequency f1 preferably satisfies equation (1) when it satisfies inequality (2):

$$f1<f2 \quad (2)$$

In each aspect, it is desirable that the apparatus further comprise, in correspondence with each set, a common wiring commonly connected to the plurality of electron-emitting devices in each set, and the set be selected by applying a selection potential different from potentials of other common wirings to the common wiring of the set to be selected. In this arrangement, the electron-beam apparatus preferably further comprises, in correspondence with the plurality of electron-emitting devices in each set, a plurality of wirings for applying a potential for emitting electrons from the electron-emitting device in cooperation with the selection potential applied to the common wiring. These wirings may be shared by electron-emitting devices belonging to separate sets. This arrangement includes one known as matrix wiring. The selection potential applied to the common wiring is desirably set such that each device is not substantially driven before a potential applied to a plurality of wirings laid out in correspondence with a plurality of devices in each set reaches a value which satisfies a predetermined condition, and the device is driven when the potential applied to a plurality of wirings laid out in correspondence with a plurality of devices in each set reaches the value which satisfies the predetermined condition. Emission of electrons from the electron-emitting device is desirably controlled by controlling a potential value or an application time of a potential applied to the plurality of wirings for applying the potential for emitting electrons from the electron-emitting device in cooperation with the selection potential applied to the common wiring. The potential or a flowing current may be controlled.

Each aspect can be preferably adopted when the electron-emitting device is a cold cathode device, and can be more preferably adopted when the electron-emitting device is a surface-conduction emission type electron-emitting device.

In each aspect, the power source can preferably use a switching power source which may be a forward type switching power source, flyback type switching power source, or resonance type switching power source.

In each aspect, the set is selected based on an input horizontal sync signal, and the power source is driven based on the horizontal sync signal to generate the output potential. The power source is driven based on the horizontal sync signal at the same frequency as the frequency of the horizontal sync signal, or a frequency which is controlled based on the frequency of the horizontal sync signal and is different from the frequency of the horizontal sync signal. The frequency for driving the power source can be controlled by a phase-locked loop. The horizontal sync signal can be used as a target to be compared by the phase-locked loop.

An image forming apparatus according to the present invention comprises a fluorescent substance for emitting light upon reception of electrons emitted by the electron-emitting device in the above-described electron-beam apparatus. In this case, the power source is desirably driven based on a sync signal included in an input image signal to generate the output potential. A selection frequency for the set is preferably based on the sync signal included in the image signal.

Still another aspect of the present invention comprises the following step.

A method of driving an electron-beam apparatus having an electron source having a plurality of sets each including a plurality of electron-emitting devices, each set being periodically selected, and the plurality of electron-emitting devices in each set being selected and allowed to simultaneously emit electrons, an accelerating electrode for receiving a potential for accelerating electrons emitted by the electron-emitting device, and a power source for supplying an output potential including an AC component to the accelerating electrode, comprises the step of controlling a frequency of the AC component of the output potential to be equal to a selection frequency for each set in the electron source.

Still another aspect of the present invention comprises the following step.

A method of driving an electron-beam apparatus having an electron source having a plurality of sets each including a plurality of electron-emitting devices, each set being periodically selected, and the plurality of electron-emitting devices in each set being selected and allowed to simultaneously emit electrons, an accelerating electrode for receiving a potential for accelerating electrons emitted by the electron-emitting device, and a power source for supplying an output potential including an AC component to the accelerating electrode, comprises the step of controlling a frequency of the AC component of the output potential to be equal to a multiple of an integer of not less than 2 of a selection frequency for each set in the electron source.

Still another aspect of the present invention comprises the following step.

A method of driving an electron-beam apparatus having an electron source having a plurality of sets each including a plurality of electron-emitting devices, each set being periodically selected at a frequency f2, and the plurality of electron-emitting devices in each set being selected and allowed to simultaneously emit electrons, an accelerating electrode for receiving a potential for accelerating electrons emitted by the electron-emitting device, and a power source for supplying an output potential including an AC component to the accelerating electrode, comprises the step of letting q be at least any natural number of 1 to 10, controlling a frequency f1 of the AC component of the output potential to satisfy equation (1), $$f1=n/(q*T) \quad (1)$$

Where n is an arbitrary natural number, and T is a period from time at which any one of the electron-emitting devices is selected and allowed to emit electrons to time at which the electron-emitting devices is selected again and allowed to emit electrons.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 9 is a block diagram showing an analog processor;

DETAILED DESCRIPTION OF THE PREFERRED EMBODIMENTS

Figure 1:
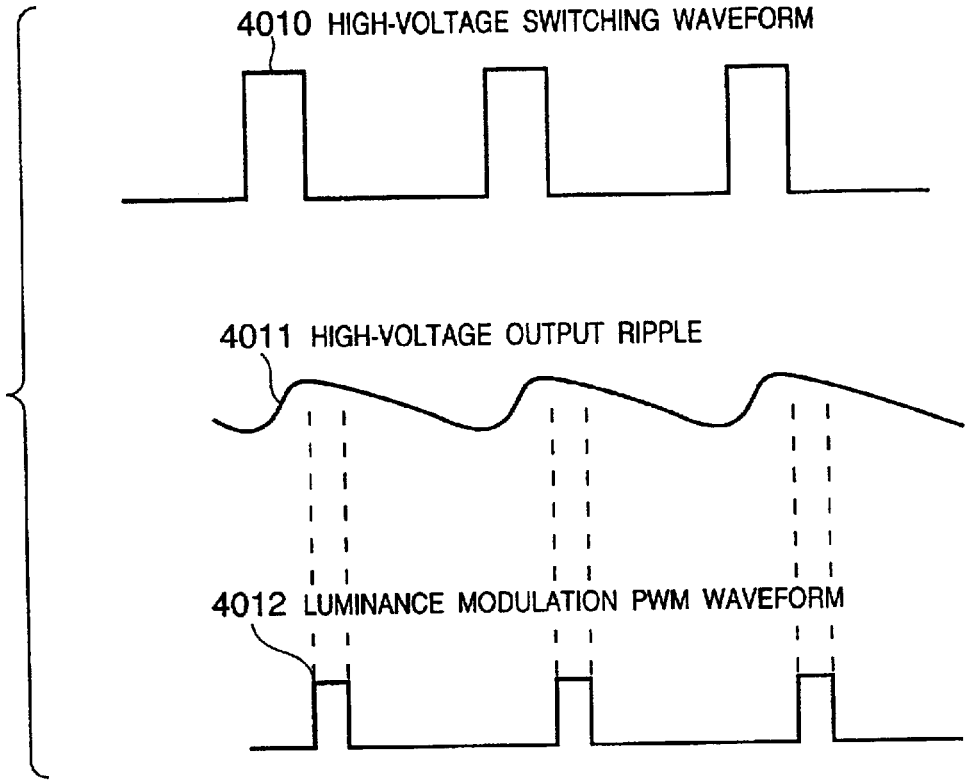
FIG. 1 is a waveform chart showing a pulse width modulation (PWM) pulse when the pulse width is constant.

Preferred embodiments of the present invention will be described below with reference to the accompanying drawings.

The following embodiments adopt a method of allowing a plurality of electron-emitting devices on a selected row to simultaneously emit electrons in driving electron-emitting devices arranged in a matrix in order to obtain a high-quality display in an arrangement in which electrons are accelerated at an accelerating potential having an output potential including an AC component. This method of allowing a plurality of devices selected during a given selection period to simultaneously emit electrons will be called line-sequential scanning, with respect to dot-sequential scanning of scanning a screen vertically and horizontally, which is executed in the CRT.

Since a plurality of devices can simultaneously emit electrons, the influence of the AC component of the accelerating potential on the emission luminance can be suppressed compared to the structure of dot-sequentially selecting a plurality of devices.

More specifically, the following embodiments use an electron source constituted by arranging a plurality of electron-emitting devices in a matrix and connecting them to pluralities of row and column wirings. The row wirings are sequentially selected one by one at a predetermined selection frequency in a predetermined selection period. A selected row wiring receives a selection potential different from the potential of an unselected row wiring. In the selection period during which a given row wiring is selected, a potential different from one applied by the row wiring is applied from a plurality of column wirings to a plurality of electron-emitting devices connected to the selected row wiring. The electron-emitting devices connected to the selected row wiring emit electrons by the potential difference between potentials applied by the row and column wirings.

Emitted electrons are accelerated by an accelerating potential applied to an anode electrode serving as an accelerating electrode. While the electron-emitting devices connected to the selected row wiring simultaneously emit electrons, the electrons can be accelerated at the same potential to suppress the influence of a ripple even if the accelerating potential includes the ripple.

When a pulse width modulation signal is applied from the column wiring, the ripple of the accelerating potential may have an influence depending on the length of a high-level (ON) period, but can be suppressed to an allowable range. Since the deviation of an actual emission luminance from a required luminance caused by the influence of the ripple can be obtained in advance, the influence can be evaluated in advance.

The influence of the AC component of the accelerating potential on the luminance can become almost uniform between adjacent rows if the frequencies for sequentially selecting a plurality of rows are equal to each other, or the frequency of the AC component of the accelerating potential is an integer multiple of a frequency for sequentially selecting a plurality of rows. The latter is more preferable because variations in potential caused by the AC component can be suppressed because of a high frequency of the AC component of the accelerating potential.

A case in which an image is continuously displayed will be considered.

In this case, one frame period T is a period from the time at which a certain electron-emitting device is selected and allowed to emit electrons to the time at which this electron-emitting device is selected again and allows to emit electrons. The "frame" forms one screen and includes the meaning "frame" used in a general television technique.

If the accelerating potential (peak value of the AC component of the accelerating potential) is different between a case in which an electron-emitting device is allowed to emit electrons in a given frame and a case in which this electron-emitting device is allowed to emit electrons in the next frame, the luminance distribution varies between successive frames. The variations become noticeable when one period of the AC component of the accelerating potential is longer than one period of the frequency for line-sequential scanning (frequency for selecting a row wiring).

In order to suppress the variations in luminance distribution, letting t1 be one period of the AC component of the accelerating potential, T/t1 is set to a natural number. In practice, even if periods of the AC component of the accelerating potential do not fall within one frame period in number corresponding to a natural number, the variations can be permitted in actually looking the screen so long as periods of the AC component of the accelerating potential fall just within 10 frames, preferable 5 frames, and more preferably 3 frames. This condition is especially important when a frequency f1 of the AC component of the accelerating potential is lower than a selection frequency f2 of line-sequential scanning (the frequency f2 is a row wiring selection frequency and is equal to the frequency of a horizontal sync signal). To make a natural number multiple of one period of the AC component of the accelerating potential falls just within y frames (y is a natural number), q*T/t1 is set to an arbitrary natural number n when q takes at least any natural number of 1 to y. In q*T/t1, "*" means to multiply preceding and subsequent values. Accordingly, the frequency f1 of the AC component of the accelerating potential is f1=1/t1=n/q*T. As the allowable range, y is a natural number of 10 or less, preferably a natural number of 5 or less, more preferably a natural number of 3 or less, and most preferably 1.

This will be described in more detail below.

For example, assume that one frame is formed from signals segmented by horizontal sync signals having a frequency f2 of 15.75 kHz. In this case, the frequency of the AC component of the accelerating potential is preferably set to 15.75 kHz or a multiple of a natural number of 15.75 kHz. More specifically, the frequency of the horizontal sync signal or a frequency obtained by multiplying the frequency of the horizontal sync signal is set as a switching frequency in generating an accelerating potential. Accordingly, the frequency of the AC component of the accelerating potential can be set equal to or a multiple of a natural number of the frequency of the horizontal sync signal. A row wiring suffices to be selected at the same frequency as the frequency of the horizontal sync signal.

Considering a condition for suppressing variations in luminance distribution between successive frames, one period t2 of the horizontal sync signal is 1/f2. Letting the frame period T be 1/60 sec, a condition for setting T/t1 to a natural number n is t1=1/(60*n). A condition for permitting a state in which the luminance distribution can vary up to 10 frames is t1=q/(60*n) where q is any natural number of 1 to 10, and n is an arbitrary natural number. This condition is preferably satisfied particularly for t1>t2.

A signal having this period can be generated based on a frame sync signal in synchronism with it. As the frame sync signal, e.g., a vertical sync signal in a CRT signal can be used. Alternatively, such signal may be generated based on a horizontal sync signal in synchronism with it. Specifically, the signal can be generated by a phase-locked loop (to be also referred to as a PLL) method. More specifically, the signal can be generated by counting, up to a count value which satisfies the above condition, the period of a reference wave having a much higher frequency than the frequency of the frame sync signal or horizontal sync signal serving as a generation source.

A luminance level control method for displaying an image such as a two-dimensional natural image includes an amplitude modulation method (to be also referred to as a PHM method) of controlling the signal amplitude (e.g., the voltage value of a voltage signal), and a method known as a pulse width modulation method (to be also referred to as a PWM method) of controlling the signal length within the selection period. The following embodiments will exemplify the PWM method superior in noise resistance and small power consumption.

The following embodiments employ a means of synchronizing the switching frequency of a high-voltage power source for supplying an accelerating voltage to be applied to an anode with the PWM horizontal frequency (row wiring selection frequency). In the first embodiment, the switching frequency of the high-voltage power source is set equal to the row wiring selection frequency. When the PWM pulse width is constant, like a waveform 4012 in FIG. 1, the anode voltage applied during the pulse ON period is constant to obtain a constant luminance.

Figure 2:
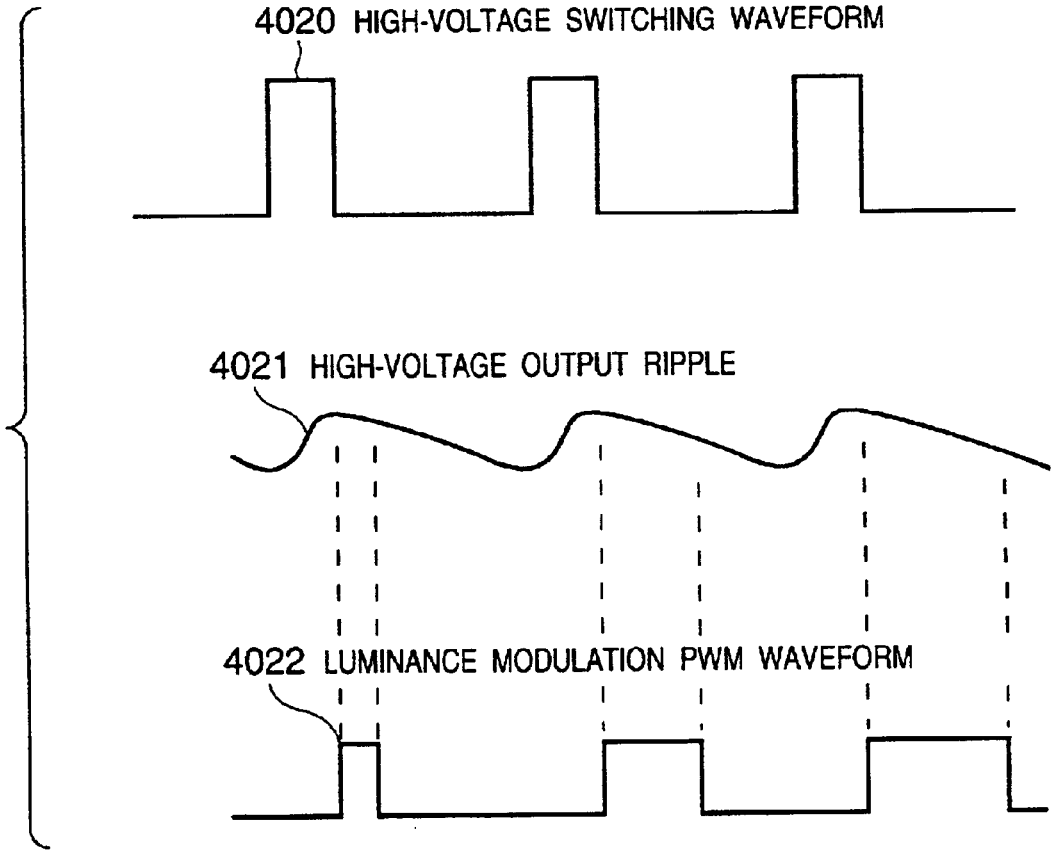
FIG. 2 is a waveform chart showing the pulse width modulation (PWM) pulse when the pulse width changes.
Figure 3:
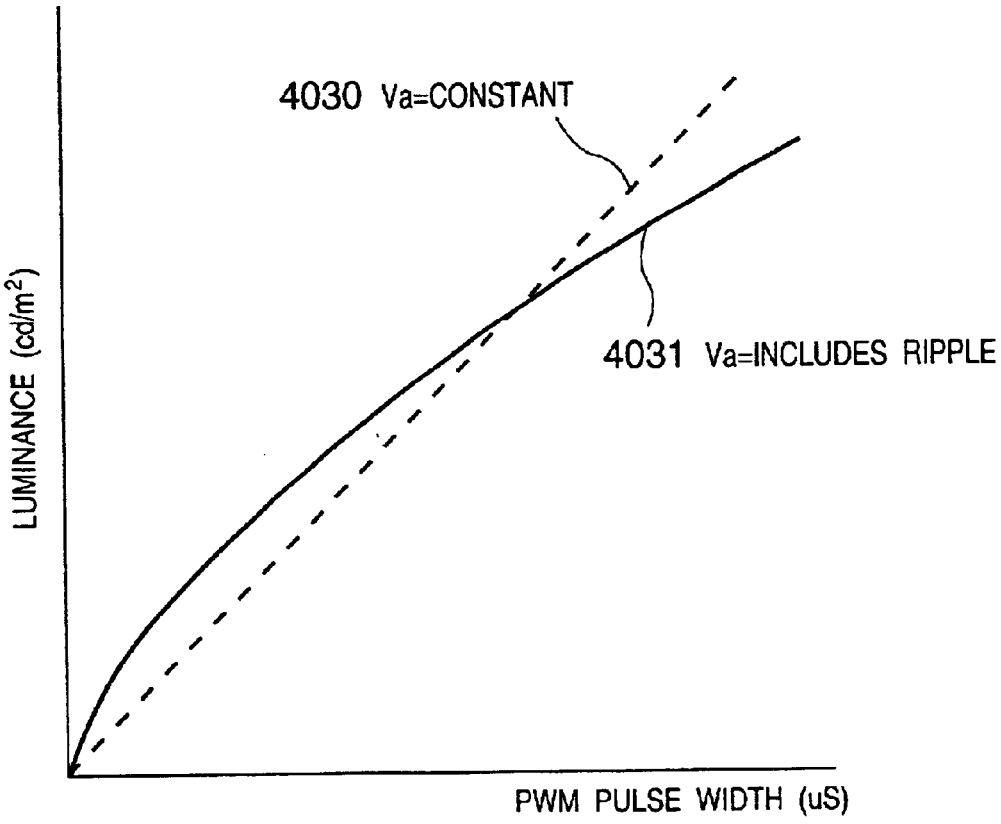
FIG. 3 is a graph showing the pulse width modulation (PWM) pulse width vs. luminance characteristic.

If the PWM pulse width changes, like a waveform 4022 in FIG. 2, the PWM pulse width vs. luminance characteristic includes a slight gamma characteristic, like a curve 4031 in comparison with a curve 4031 for Va=constant, as shown in FIG. 3. However, the gray level can be satisfactorily expressed.

Figure 4:
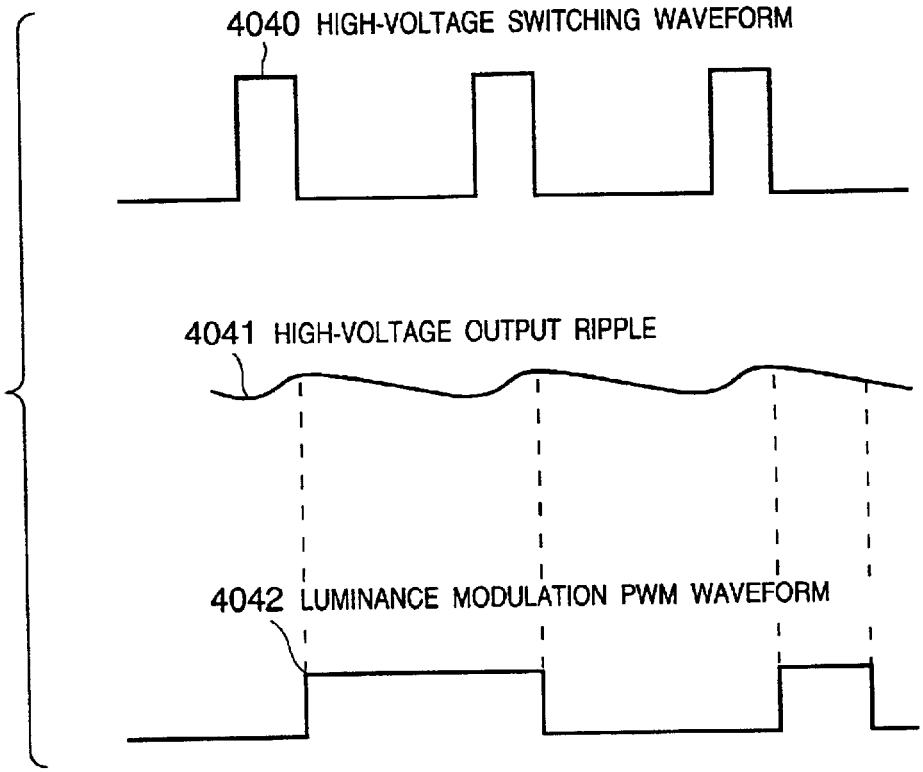
FIG. 4 is a waveform chart showing the pulse width modulation (PWM) pulse when a high-voltage switching frequency is set to an integer multiple of a PWM horizontal frequency.
Figure 5:
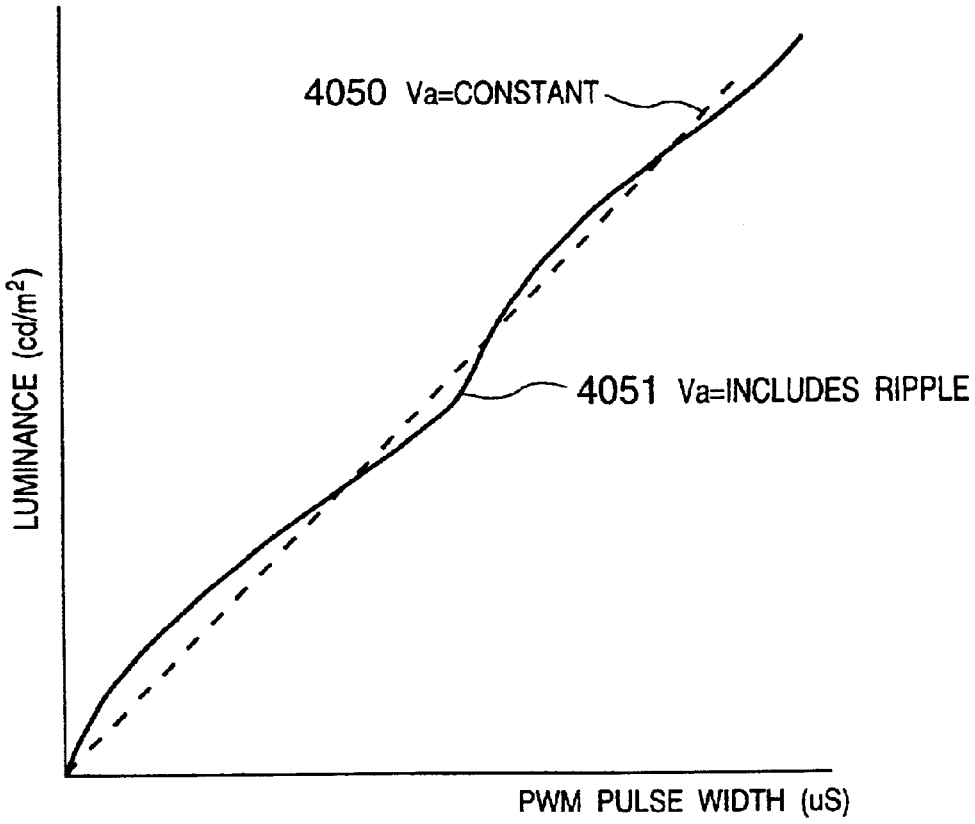
FIG. 5 is a graph showing the pulse width modulation (PWM) pulse width vs. luminance characteristic when the high-voltage switching frequency is set to an integer multiple of the PWM horizontal frequency.

When the switching frequency of the high-voltage power source is synchronized with an integer multiple of the PWM horizontal frequency, the voltage ripple decreases, like a ripple 4041 in FIG. 4, because of a high frequency. Hence, the PWM pulse width vs. luminance characteristic comes very close to a curve 4050 for Va=constant, and the gray level can be satisfactorily expressed.

Figure 10:
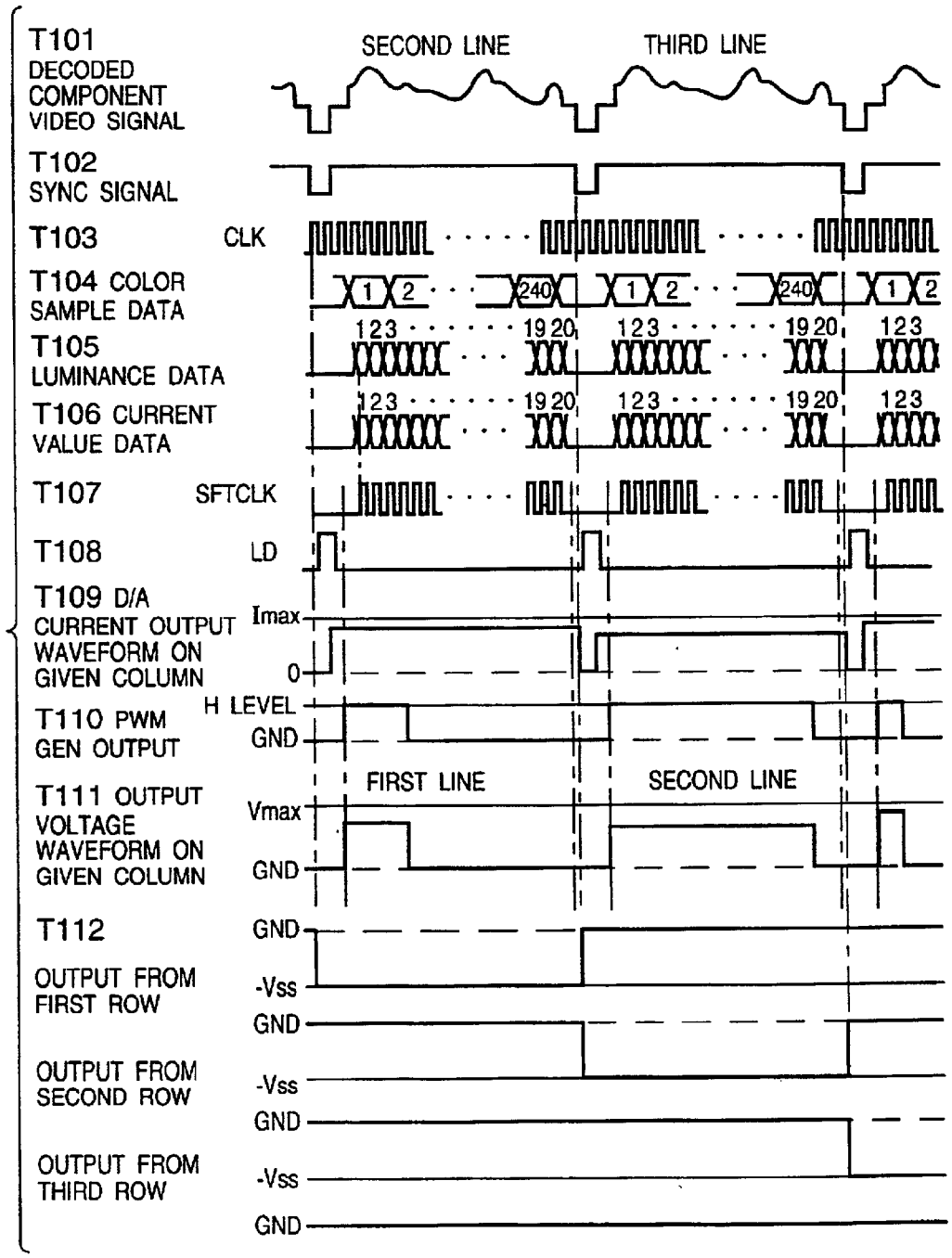
FIG. 10 is a timing chart for explaining the operation of the display panel driving circuit.

FIGS. 6, 7, 8, and 9 are block diagrams showing an SED panel driving circuit, and FIG. 10 is a timing chart.

Figure 6:
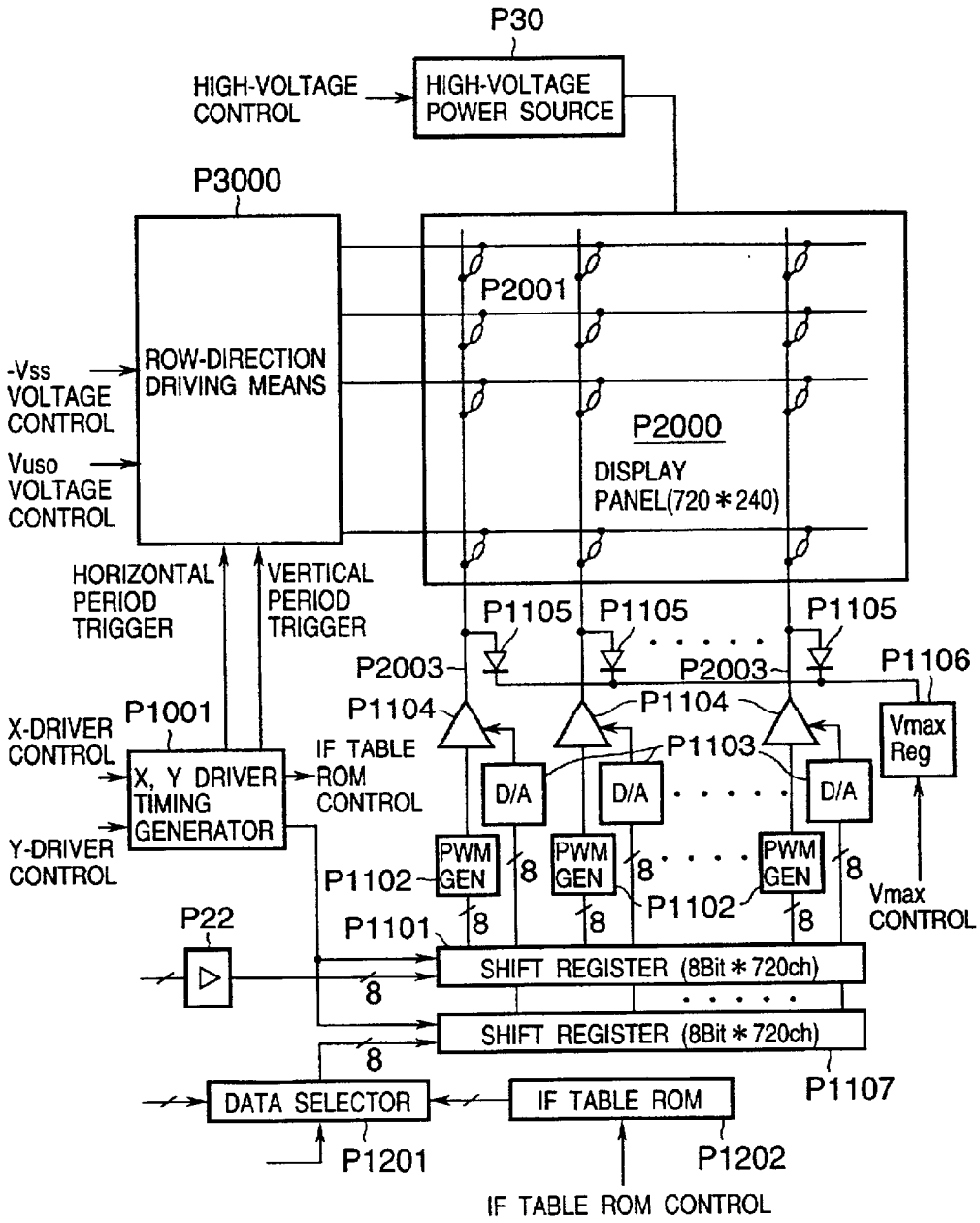
FIG. 6 is a block diagram showing a display panel driving circuit.

As shown in FIG. 6, reference symbol P2000 denotes a display panel. In this embodiment, the display panel P2000 is constituted by arranging 240*720 surface-conduction emission type devices P2001 in a matrix by 240 vertical row wirings and 720 horizontal column wirings. An electron beam emitted by each surface-conduction emission type device P2001 is accelerated by a high voltage applied from a high-voltage power source P30 to irradiate a fluorescent substance (not shown), thereby emitting light. The fluorescent substance (not shown) can take various color layouts in accordance with application purposes. For example, the fluorescent substance takes a vertical striped color layout of R, G, and B colors.

This embodiment will exemplify an application of displaying an NTSC television image on a display panel having pixels of 240 horizontal lines (R, G, and B trio)*240 vertical lines. Almost the same arrangement can cope with not only the NTSC image but also image signals having different resolutions and frame rates, such as a high-resolution HDTV image and computer output image.

Figure 7:
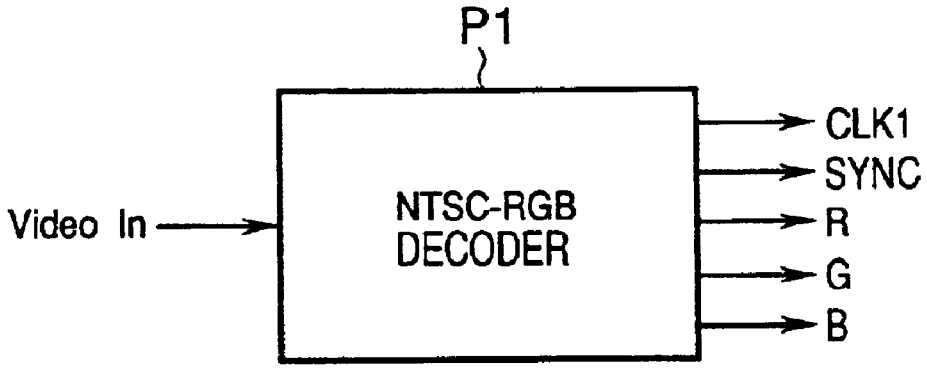
FIG. 7 is a block diagram showing an NTSC-RGB decoder.

As shown in FIG. 7, reference symbol P1 denotes an NTSC-RGB decoder for receiving an NTSC composite video input and outputting R, G, and B components. This decoder separates and outputs a sync signal (SYNC) superposed on an input video signal. Similarly, the decoder separates a color burst signal superposed on the input video signal, and generates and outputs a CLK signal (CLK1) which synchronizes with the color burst signal.

Figure 8:
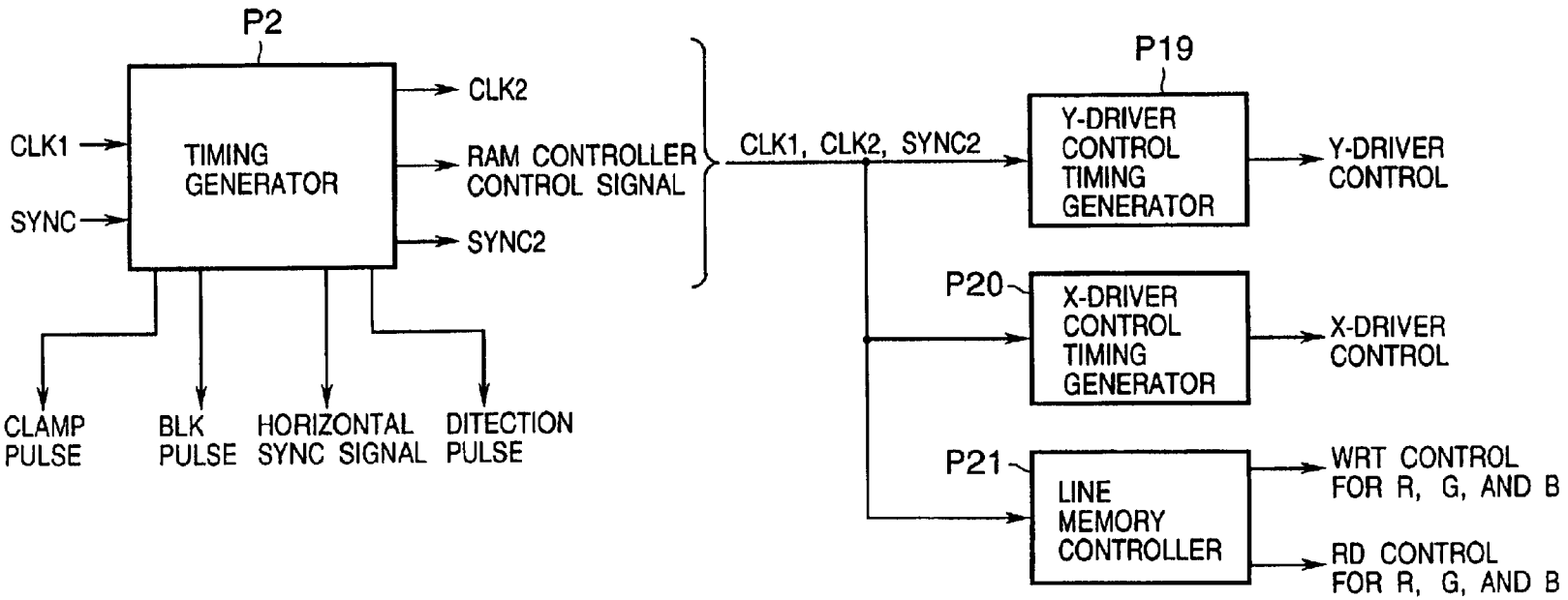
FIG. 8 is a block diagram showing a timing generator.

As shown in FIG. 8, reference symbol P2 denotes a timing generator for generating a horizontal sync signal for synchronizing the high-voltage power source P30 with the following timing signals necessary for converting R, G, and B analog signals decoded by P1 into digital gray level signals for performing luminance modulation in accordance with the SED panel. The timing generator P2 mainly executes the following operations.

The timing generator P2 outputs a clamp pulse for DC-regenerating R, G, and B analog signals from P1 by analog processors P3.

The timing generator P2 outputs a blanking pulse (BLK pulse) for adding blanking periods to the R, G, and B analog signals from P1 by the analog processors P3.

The timing generator P2 outputs a detection pulse for detecting the levels of the R, G, and B analog signals by video detectors P4.

The timing generator P2 outputs a sample pulse (not shown) for convering the R, G, and B analog signals into digital signals by A/D converters P6.

The timing generator P2 outputs a RAM controller control signal necessary for a RAM controller P12 to control RAMs P8.

When the timing generator P2 receives CLK1, the timing generator P2 generates and outputs a free-running CLK signal (CLK2) which synchronizes with CLK1 from the internal PLL circuit in P2.

The timing generator P2 outputs a sync signal (SYNC2) generated in P2 based on CLK2.

(The timing generator P2 having the free-running CLK2 generation means can generate CLK2 and SYNC2 serving as reference signals even when no input video signal exists, and thus an image can be displayed by reading out image data in the RAM means P8.)

The timing generator P2 outputs a horizontal sync signal for horizontally synchronizing with the high-voltage power source P30.

As shown in FIG. 9, the analog processors P3 are disposed for respective primary color signals output from P1. Each analog processor P3 mainly performs the following operation.

The analog processor P3 receives a clamp pulse from P2 and performs DC regeneration.

The analog processor P3 receives a BLK pulse from P2 and adds a blanking period.

The analog processor P3 receives a gain adjustment signal from a corresponding D/A converter P14 serving as one of control outputs of a system controller mainly made up of a MPU P11, and controls the amplitudes of primary color signals input from P1.

The analog processor P3 receives an offset adjustment signal from the D/A converter P14 serving as one of control outputs of the system controller mainly made up of the MPU P11, and controls the black levels of primary color signals input from P1.

Each video detector P4 detects an input video signal level or a video signal level after control by the analog processor P3. The video detector P4 receives a detection pulse from P2, and the detection result is read by an A/D converter P15 serving as one of control inputs of the system controller mainly made up of the MPU P11.

The detection pulse from P2 is formed from, e.g., three, gate pulse, reset pulse, and sample & hold (to be referred to as S/H hereinafter) pulse. The video detector is comprised of, e.g., an integrator and S/H circuit.

For example, the integrator integrates a video signal in accordance with a gate pulse during the effective period of an input video signal, and the S/H circuit samples an output from the integrator in accordance with an S/H pulse generated during a vertical blanking period. The detection result is read by the A/D converter P15 during this vertical blanking period, and then the integrator and S/H circuit are initialized by a reset pulse.

This operation enables detecting the average video level of each field.

Each LPF P5 is a pre-filter means arranged on the input stage of a corresponding A/D converter P6.

The A/D converter P6 is an A/D converter means for receiving a sample CLK from P2 and quantizing an analog primary color signal having passed through the LPF P5 by a necessary number of gray levels.

Each inverse γ table P7 is a gray level characteristic conversion means adopted to convert an input video signal into the emission characteristic of the display panel. When the luminance level is expressed by pulse width modulation, like this embodiment, the emission amount often exhibits a linear characteristic almost proportional to the size of luminance data. On the other hand, a video signal applies to a TV receiver using a CRT, and thus undergoes γ processing in order to correct the nonlinear emission characteristic of the CRT. For this reason, in displaying a TV image on a panel having a linear emission characteristic, like this embodiment, the effects of γ processing must be cancelled by a gray level characteristic conversion means such as P7.

The emission characteristic can be properly changed by switching table data by an output from an I/O controller P13 serving as one of control inputs/outputs of the system controller mainly made up of the MPU P11.

Reference symbols P8 denote image memories which are arranged for respective R, G, and B processors and have addresses for the total number of display pixels of the panel (in this case, 240 horizontal lines*240 vertical lines*3 addresses). Each memory stores luminance data each panel pixel should emit. Luminance data are dot-sequentially read out to display an image stored in the memory on the panel.

Luminance data is output from P8 under address control of the RAM controller P12.

Data is written in P8 under the control of the system controller mainly made up of the MPU P11. For a simple test pattern, the RAM P8 calculates, generates, and writes luminance data to be stored at each address in P8. For a natural still image pattern, an image file stored in, e.g., an external computer is loaded via a serial communication I/F P16 serving as one of inputs/outputs of the system controller mainly made up of the MPU P11, and the loaded file is written in the image memory P8.

Reference symbols P9 denote data selectors which determine whether image data to be output is data from the image memory P8 or data from the A/D converter P6 (input video signal system), on the basis of an output from the I/O controller P13 serving as one of control inputs/outputs of the system controller mainly made up of the MPU P11.

In addition to the two input selection systems, a mode of generating a fixed value from P9 is prepared. This mode can be selected by P13 to output the fixed value. In this mode, e.g., an adjustment signal such as a whole white pattern can be displayed at a high speed without any external input.

Reference symbols P10 denote horizontal 1-line memory means arranged for respective primary color signals. The horizontal 1-line memory means P10 rearrange luminance data input parallel to the three, R, G, and B systems into an order corresponding to the panel color layout, converts the luminance data into a serial signal of one system, and outputs the converted signal to an X driver via a latch means P22.

The system controller is mainly comprised of the MPU P11, the serial communication I/F P16, the I/O controller P13, the D/A converter P14, the A/D converter P15, a data memory P17, and a user SW means P18.

The system controller receives a user request from the user SW means P18 or serial communication I/F P16, and outputs a corresponding control signal from the I/O controller P13 or D/A converter P14 to meet the request.

In addition, the system controller performs optimal automatic control by receiving a system monitoring signal from the A/D converter P15 and outputting a corresponding control signal from the I/O controller P13 or D/A converter P14.

In this embodiment, the user request includes generation of a test pattern, change of the gray level, and display control such as brightness or color control. By monitoring the average video level from the video detector P4 by the A/D converter P15, automatic control such as ABL can be achieved. The data memory P17 can store the user adjustment amount.

Reference symbol P19 denotes a Y-driver control timing generator; and P20, an X-driver control timing generator. Both the generators P19 and P20 receive signals CLK1, CLK2, and SYNC2 to generate Y- and X-driver control signals.

Reference symbol P21 denotes a controller for performing timing control of the line memory P10. The controller P21 receives the signals CLK1, CLK2, and SYNC2, and generates R, G, B_WRT control signals for writing luminance data in the line memory, and R, G, B_RD control signals for reading out luminance data from the line memory in an order corresponding to the panel color layout.

Reference symbol T104 in FIG. 10 denotes a color sample data string waveform obtained by displaying one of R, G. and B colors. The waveform T104 is made up of 240 data strings per horizontal period. These data strings are written in the line memory P10 during one horizontal period in accordance with a control signal. In the next horizontal period, data strings are read out from the line memory P10 of each color at a frequency three times higher than the write frequency, thereby obtaining 720 luminance data strings per horizontal period, like a waveform T105.

Reference symbol P1001 denotes an X & Y-driver timing generator which receives control signals from the Y-driver control timing generator P19 and X-driver control timing generator P20, and outputs the following signals for the control of the X driver:

Shift clock

LD pulse (functioning to fetch data read in shift registers P1101 and P1107 in the internal memory means (not shown) of PWM generators P1102 and D/A converters P1103, and functioning as a horizontal period trigger for the PWM generators P1102 and D/A converters P1103)

If table ROM control signal.

The X & Y-driver timing generator P1001 outputs a horizontal period shift clock for operating the Y shift register in order to control the Y driver, and a vertical period trigger signal for applying a row scanning start trigger.

The shift register P1101 loads the luminance data strings of 720 column wirings from the latch means P22 every horizontal period in accordance with a shift clock such as a shift clock T107 in FIG. 10 which synchronizes with luminance data and is output from the X & Y-driver timing generator P1001. Then, the shift register P1101 transfers 720 data of one horizontal line to the PWM generators P1102 at once in accordance with an LD pulse such as a pulse T108.

The shift register P1107 loads the column wiring driving current data strings of 720 column wirings from a data selector means P1201 every horizontal period in accordance with a shift clock, similar to luminance data. Then, the shift register P1107 transfers 720 data of one horizontal line to the D/A converters P1103 at once in synchronism with an LD pulse such as the pulse T108.

An If table ROM P1202 is a memory means for storing data of a current amplitude value to be flowed through 720*240 surface-conduction emission type devices of the display panel P2000. The If table ROM P1202 undergoes read address control in accordance with an If table ROM control signal from the X & Y-driver timing generator P1001, and outputs data of 720 current amplitude values for one row to be scanned, such as the data T105 in FIG. 10 every horizontal period.

Using the If table ROM P1202, a current value for driving the column wiring (i.e., surface-conduction emission type electron-emitting device) is optimized for each device, thereby making the luminance uniform.

The data selector means P1201 is adopted for a case in which the If table ROM P1202 is not used in order to reduce the cost and the like. The data selector means P1201 outputs, to the shift register P1107 in accordance with a switching signal from the I/O controller P13, If setting data output from the I/O controller P13 serving as one of control inputs/outputs of the system controller mainly made up of the MPU P11.

The PWM generator P1102 arranged on each column wiring receives luminance data from the shift register P1101, and generates a pulse signal having a pulse width proportional to the data size every horizontal period, such as a waveform T10 in FIG. 10.

The D/A converter P1103 arranged on each column wiring is a digital-to-analog converter for a current output. This D/A converter P1103 receives current amplitude value data from the shift register P1107, and generates a driving current having a current amplitude proportional to the data size every horizontal period, such as a waveform T111 in FIG. 10.

Reference symbols P1104 denote switching means each formed from a transistor and the like. Each switching means P1104 applies a current output from the D/A converter P1103 to a column wiring while an output from the PWM generator P1102 is valid, and grounds the column wiring while an output from the PWM generator P1102 is invalid. A column wiring driving waveform is represented by T111 of FIG. 10.

Diode means P1105 arranged on respective column wirings are connected on the common side to a Vmax regulator P1106. The Vmax regulator P1106 is a constant-voltage source capable of sucking a current, and forms together with the diode means P1105 a protection circuit for preventing an excessive voltage from being applied to 720*204 surface-conduction emission type devices of the display panel P2000.

The protection voltage (potential defined by Vmax and −Vss applied upon scanning selection of a row wiring) is applied by the D/A converter P14 serving as one of control inputs/outputs of the system controller mainly made up of the MPU P11. Hence, the Vmax regulator P1106 can change the potential Vmax (or potential −Vss) in order to control the luminance control in addition to prevent application of an excessive voltage to the device.

Figure 21:
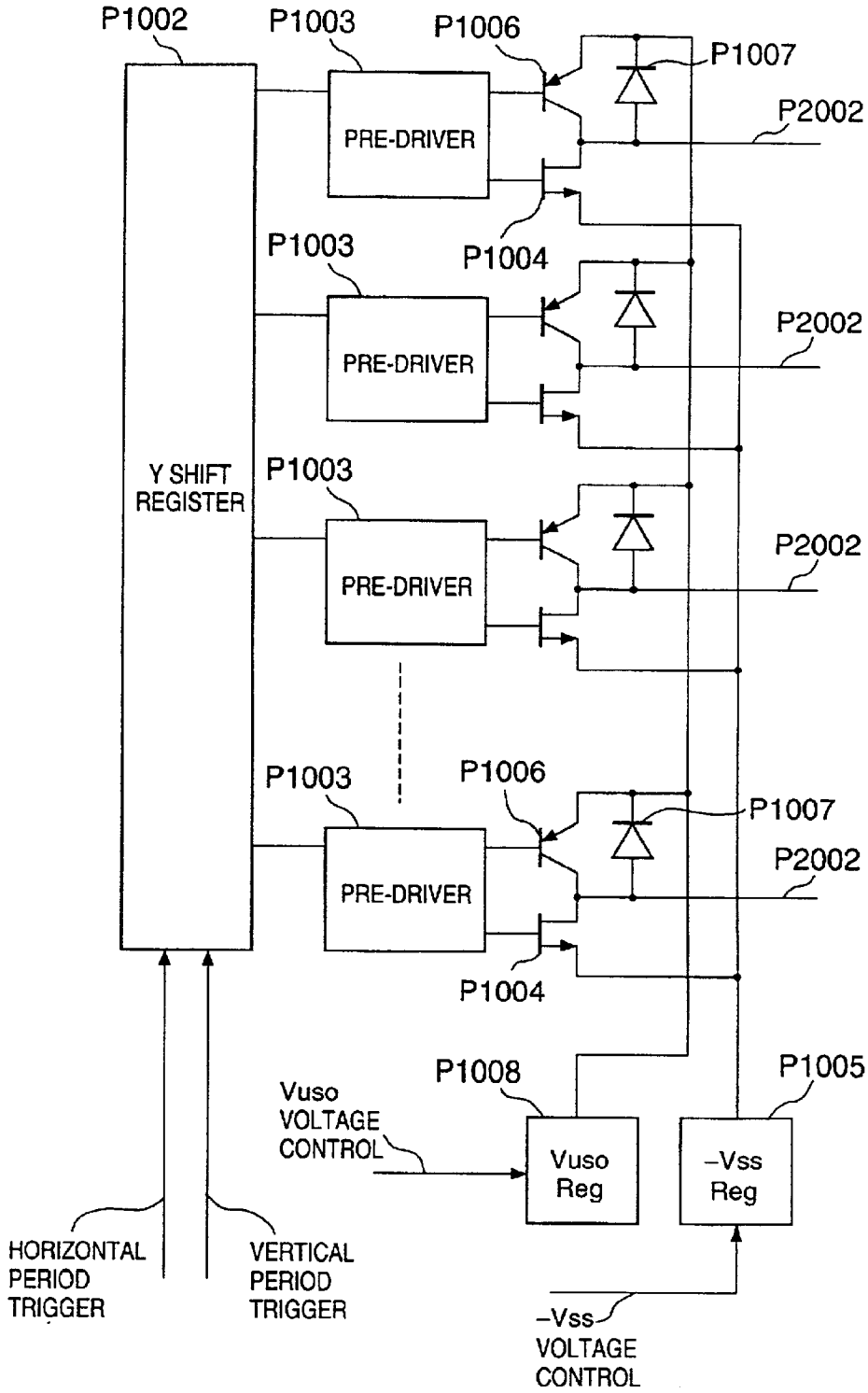
FIG. 21 is a block diagram showing a row-direction driving means.

FIG. 21 is a block diagram showing a row-direction driving means.

As shown in FIG. 21, a Y shift register P1002 receives a horizontal period shift clock and a vertical period trigger signal for supplying a row scanning start trigger from the X & Y-driver timing generator P1001, and sequentially outputs selection signals for scanning row wirings to pre-drivers P1003 arranged on respective row wirings P2002. The output unit for driving each row wiring is made up of, e.g., a transistor means P1006, FET means P1004, and diode means P1007. The pre-driver P1003 drives this output terminal at a high response speed. In selecting a row, the FET means P1004 applies the potential −Vss from a constant-voltage regulator P1005 to the row wiring via a switching means which is turned on in selection. In selecting no row, the transistor means P1006 applies a potential Vuso from the constant-voltage regulator P1008 to the row wiring via a switching means which is turned on in non-selection. A row wiring driving waveform is represented by T112 of FIG. 10.

The diode means P1007 is used to prevent generation of an abnormal potential on the row wiring and protect the output terminal for driving each row wiring.

The constant-voltage regulator P1005 for generating the potentials −Vss and Vuso is controlled by the D/A converter P14 serving as one of control inputs/outputs of the system controller mainly made up of the MPU P11.

The high-voltage power source P30 is also controlled by the D/A converter P14 serving as one of control inputs/outputs of the system controller mainly made up of the MPU P11.

[First Embodiment]

The first embodiment concerns an example of synchronizing the horizontal sync frequency of the SED and the FBT (FlyBack Transformer; to be referred to as FBT hereinafter) type high-voltage power source.

Figure 11:
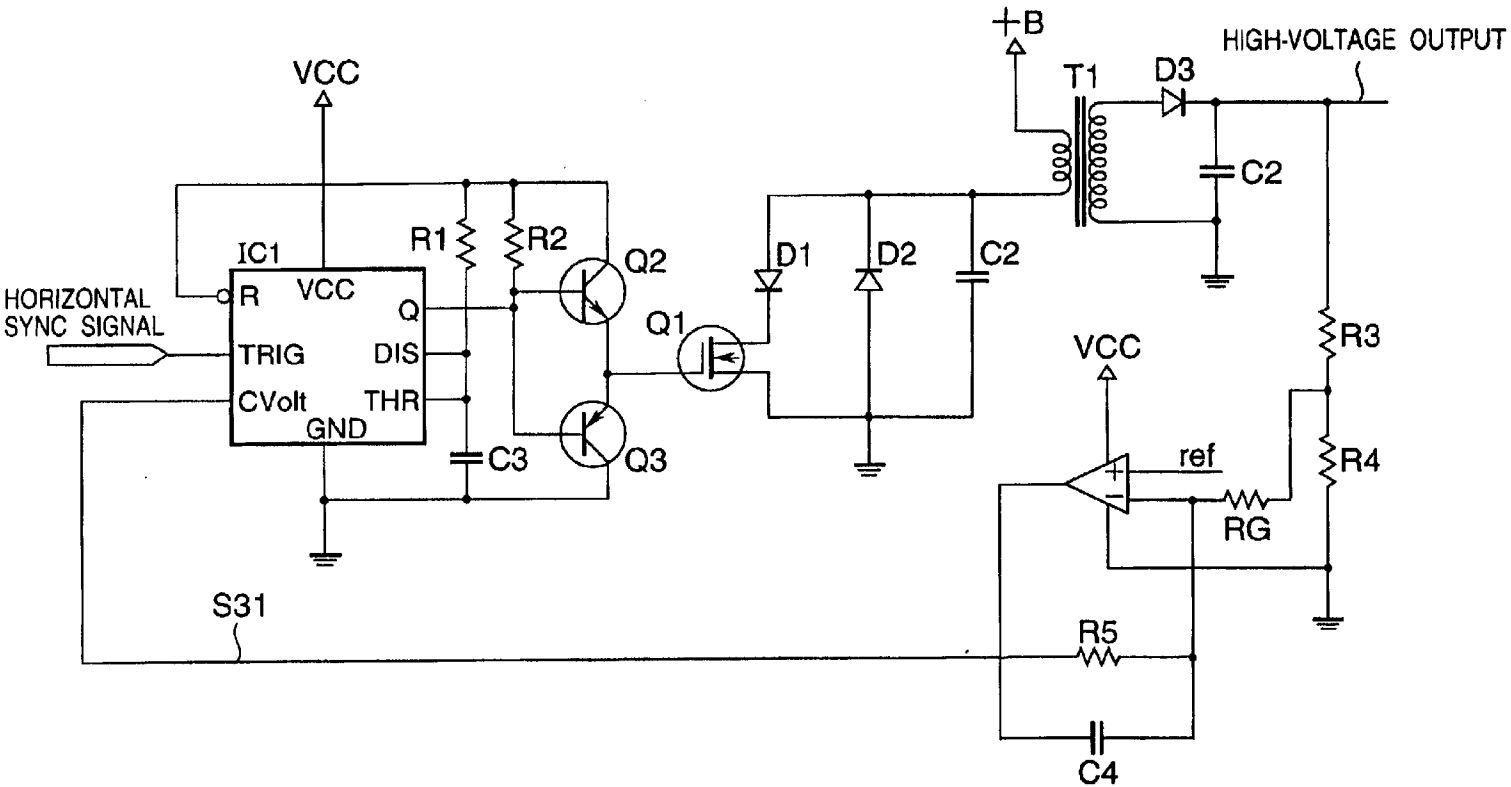
FIG. 11 is a circuit diagram showing a flyback type high-voltage generation means in the first embodiment.

FIG. 11 is a circuit diagram showing the arrangement of a high-voltage power source used in the first embodiment.

As shown in FIG. 11, reference symbol IC1 denotes an external synchronization type multivibrator capable of controlling a pulse width with a voltage. When a horizontal sync signal input from a timing generator P2 changes to L (Low) level, the multivibrator IC1 discharges a capacitance C3, and controls outputs from transistors Q2 and Q3 to H level. At this time, the H-level width is determined by a DC voltage applied to S31 and the terminal voltage of C3.

When a MOSFET (Q1) is switched by the transistors Q2 and Q3, the cathode of a diode D1 is grounded, and a voltage +B is applied to the primary side of an FBT (T1) to flow a current.

When outputs from the transistors Q2 and Q3 change to L (Low) level after a predetermined time, Q1 is turned off, the current flowing through the primary side of the FBT T1 flows into a capacitance (to be also referred to as CAP hereinafter) C1. The inductance on the primary side of the FBT (T1) and the capacitance of the CAP (C1) resonate to generate across the CAP (C1) a flyback voltage several to several ten times the voltage +B.

The FBT (T1) outputs to the secondary side of the FBT (T1) a flyback voltage corresponding to the number of turns of the transformer that is n times the flyback voltage generated on the primary side. The flyback voltage output to the secondary side is rectified into a DC voltage by a diode D3, and the DC voltage is applied as an anode voltage to a display panel P2000.

The anode voltage is divided by resistors R3 and R4, amplified by an amplifier, and applied to IC1 via S31 to control a high-voltage output to be almost constant during the PWM ON period.

Figure 20:
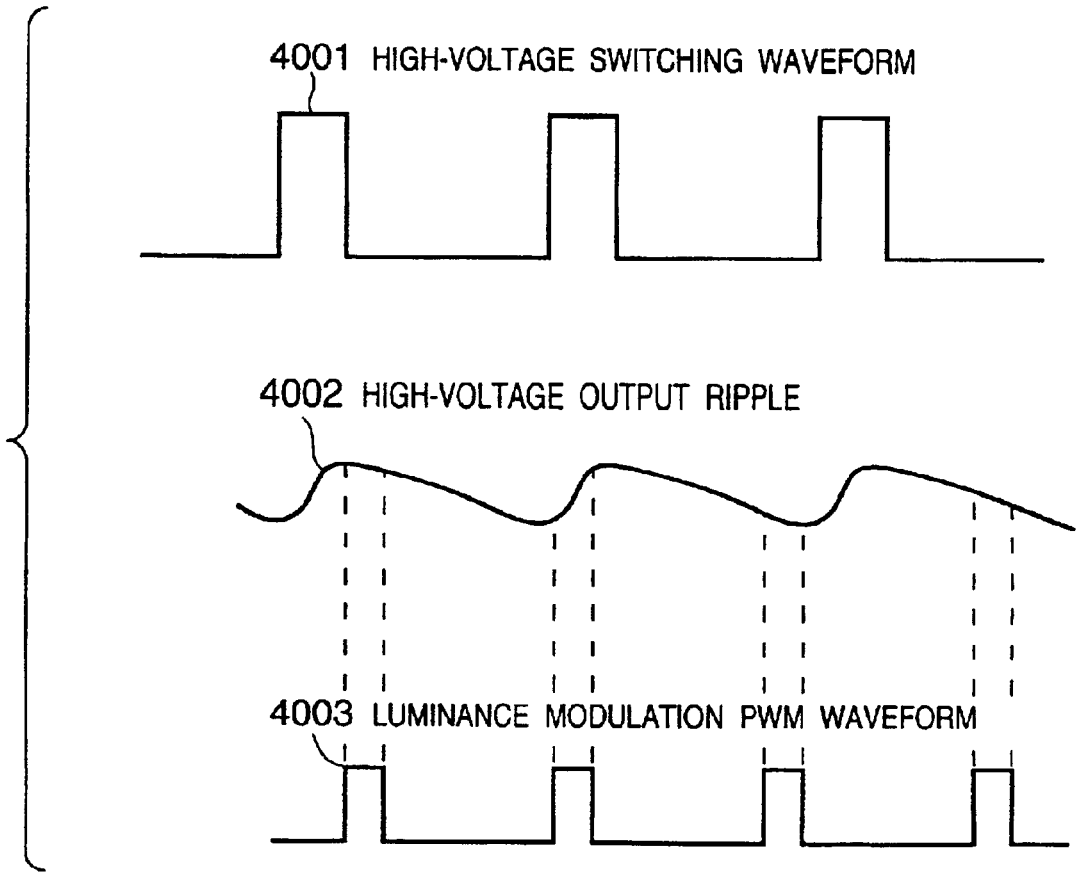
FIG. 20 is a waveform chart showing the pulse width modulation (PWM) pulse when the high-voltage ripple is large.

In this manner, the switching frequency of the high-voltage power source applied to the anode is synchronized with the PWM horizontal sync frequency. When an output from the high-voltage power source includes a voltage ripple such as a ripple 4002 in FIG. 20, the voltage ripple level may be unexpectedly high or low during the ON period of a PWM pulse 4003. Even with the same PWM pulse width, the anode voltage varies during the PWM ON period, generating a luminance difference. To the contrary, when the PWM pulse width is constant, like the waveform 4012 in FIG. 1, the anode voltage applied during the pulse ON period is constant to obtain a constant luminance.

If the PWM pulse width changes, like the waveform 4022 in FIG. 2, the PWM pulse width vs. luminance characteristic includes a slight gamma characteristic, like the curve 4031 in comparison with the curve 4030 for Va=constant, as shown in FIG. 3. However, the gray level can be satisfactorily expressed.

[Second Embodiment]

Figure 12:
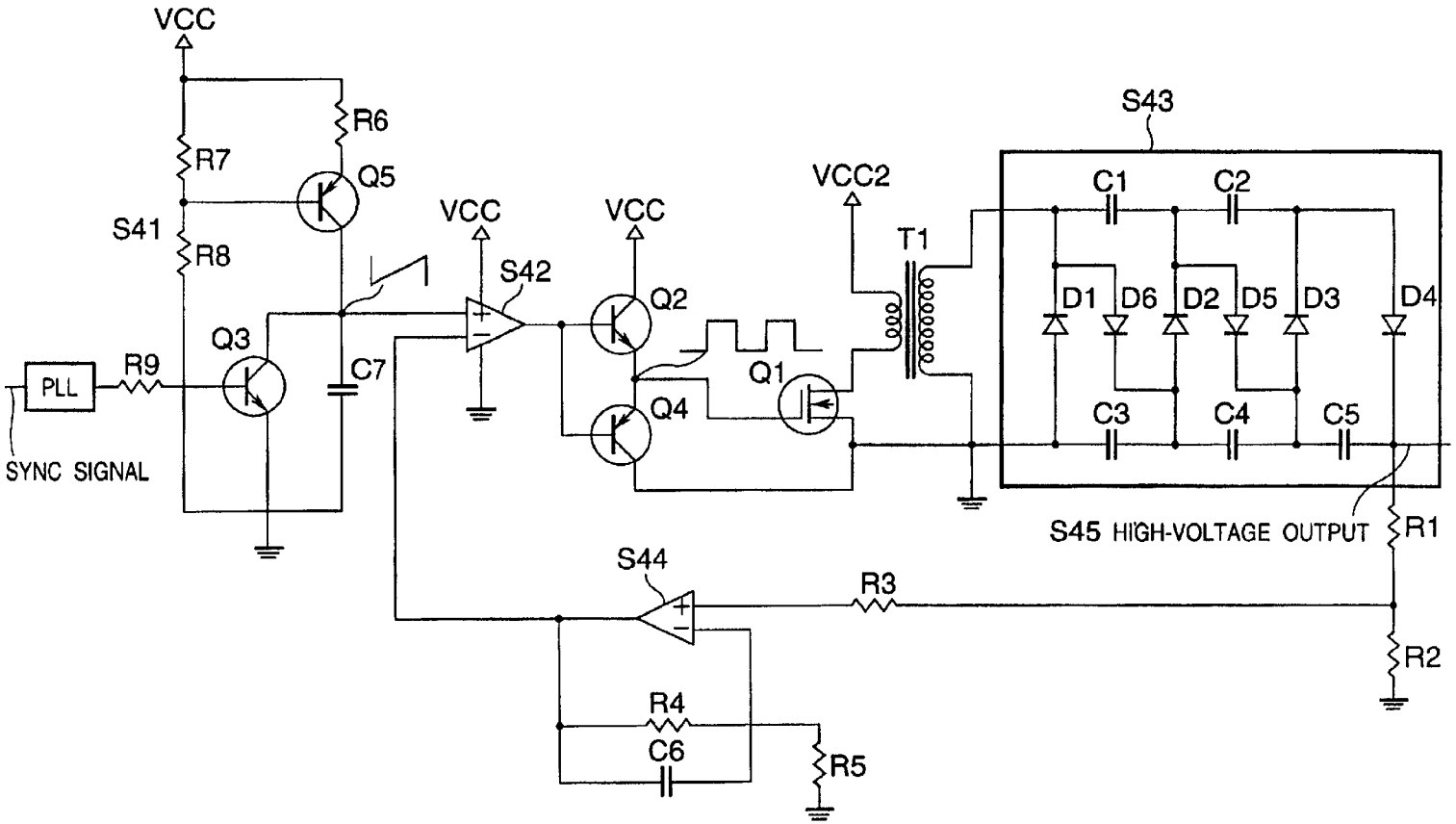
FIG. 12 is a block diagram showing a frequency multiplication type high-voltage generation means in the second embodiment.

The second embodiment employs a switching type high-voltage power source P30 which synchronizes with a frequency obtained by multiplying a horizontal sync signal from a timing generator P2. This arrangement is shown in FIG. 12. Detailed functions of the respective units have already been described in the first embodiment, and a description thereof will be omitted.

A horizontal sync signal input to the high-voltage power source P30 is multiplied by a PLL (Phase-Locked Loop) S41 to output a sync signal having a frequency nearer one which gives the highest efficiency to the high-voltage power source. For example, when the horizontal sync signal has the same frequency of 15.75 kHz as an NTSC horizontal sync signal, the PLL S41 outputs a four-time frequency of 63 kHz.

Figure 13:
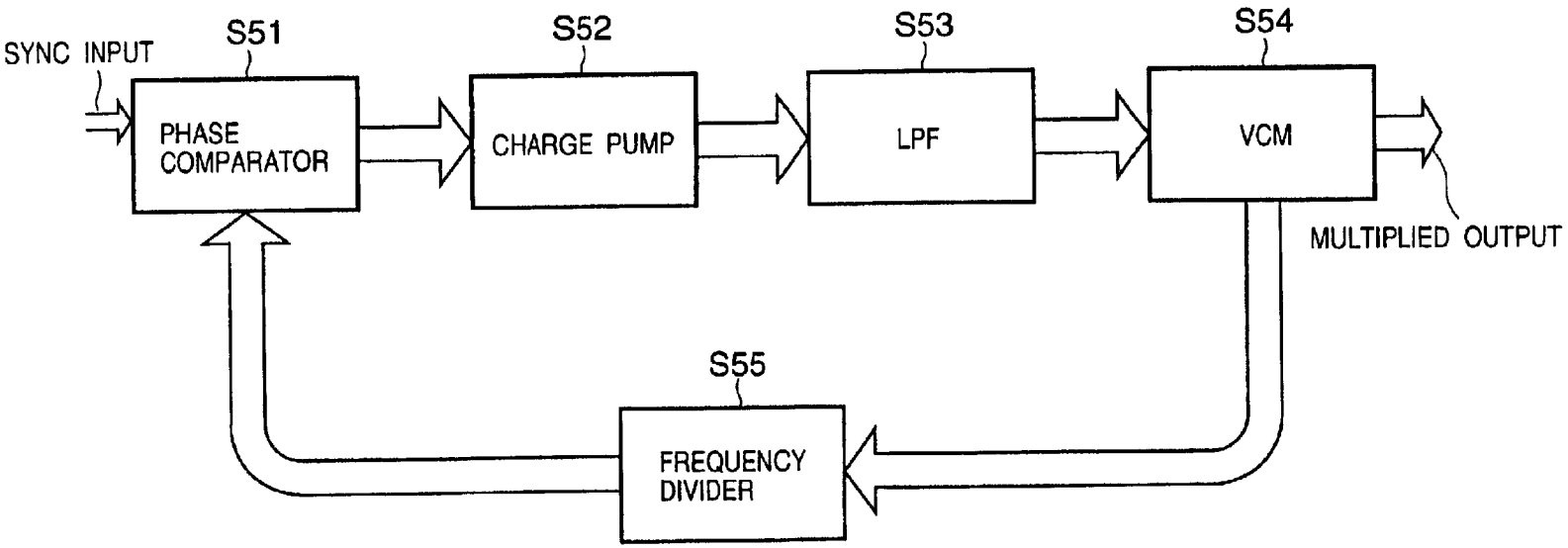
FIG. 13 is a block diagram showing the phase-locked loop (PLL) of the frequency multiplication type high-voltage generation means in the second embodiment.

The PLL (S41) will be explained with reference to FIG. 13.

A phase comparator S51 compares the phase of a sync signal input in FIG. 13 with that of a signal obtained by dividing (1/integer) by a frequency divider S55 the frequency of an oscillation output from an internal VCM (Voltage Control Multivibrator; to be referred to as VCM hereinafter) S54. Then, the phase comparator S51 outputs a pulse width corresponding to the phase difference.

The pulse output from the phase comparator S51 is outputs to an LPF (Low-Pass Filter; to be referred to as an LPF hereinafter) S53 via a charge pump S52 only during the pulse width period.

The LPF (S53) is constituted by simple R and C filters, and integrates a pulse output from the charge pump S52 into a DC voltage.

The VCM (S54) is a square wave output oscillator capable of controlling the oscillation frequency by the DC voltage of the LPF (S53). This VCM (S54) allows obtaining a multiplied-output sync signal which synchronizes with an input sync signal.

The sync signal multiplied by the PLL (S41) drives a transistor Q3. Then, a capacitance C7 discharges every predetermined period to obtain across C7 a sawtooth wave which synchronizes with a sync signal output from the PLL (S41). This sawtooth wave is compared by a comparator S42 with a DC voltage obtained by dividing an output from a high-voltage output S45 by R1 and R2 and amplifying the divided output by an amplifier S44. Then, the comparator S42 obtains a PWM output which synchronizes a sync signal output from the PLL (S41).

The PWM signal obtained by the comparator S42 drives an FET (Q1) via transistors Q2 and Q4. When the FET (Q1) is turned on, the primary side of a transformer T1 flows a current only during the ON period, thereby obtaining a square-wave voltage.

The square-wave voltage obtained on the primary side of the transformer T1 is output to the secondary side as an n-time voltage in accordance with the turn count ratio (n) of the transformer T1.

The square-wave voltage obtained on the primary side of the transformer T1 is output to the high-voltage output S45 as a DC voltage output double an output voltage from a transformer T2 via a generally used double voltage rectifying circuit S43.

The high voltage obtained by S45 is divided by R1 and R2, returns to the comparator S42 via the amplifier S44, and acts to keep the high voltage constant. However, the ripple still remains.

Figure 14:
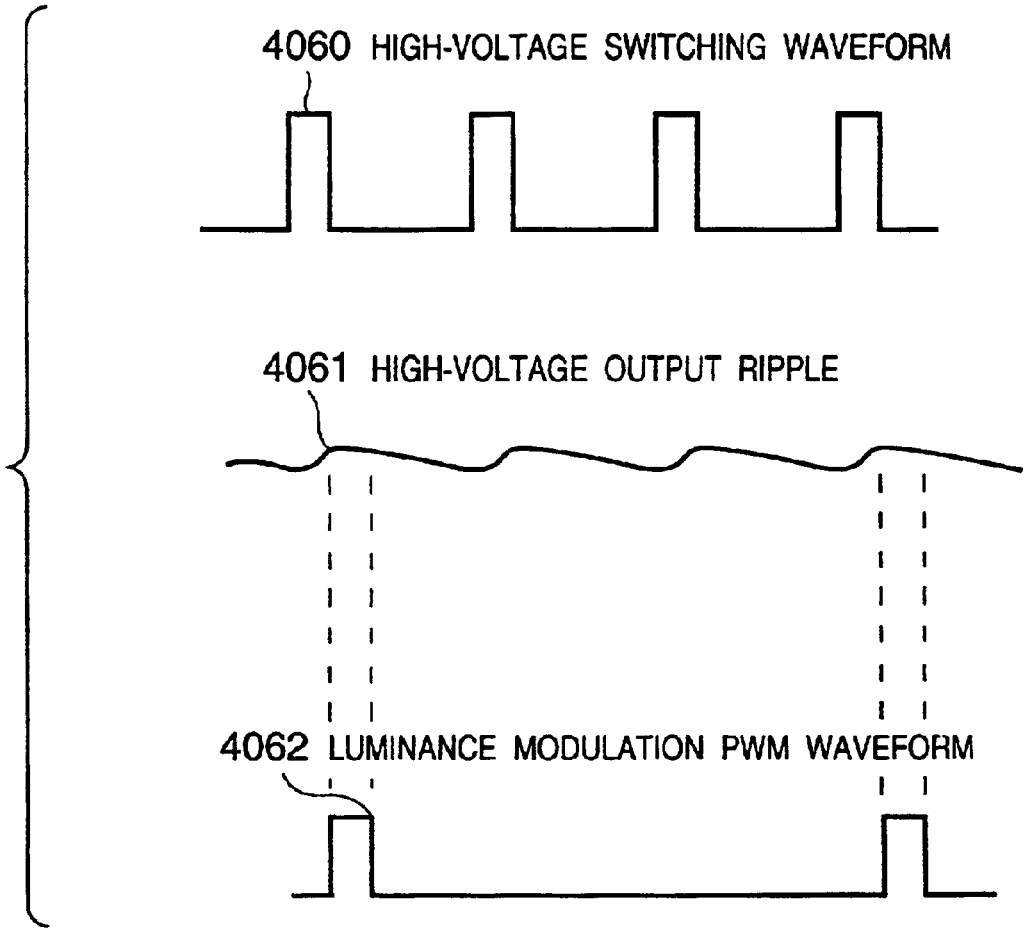
FIG. 14 is a waveform chart showing the pulse width modulation (PWM) pulse when the pulse width is constant.

In this fashion, the switching frequency of the high-voltage power source voltage applied to the anode is synchronized with a four-multiple of the PWM horizontal sync frequency. When an output from the high-voltage power source includes a voltage ripple such as the ripple 4002 in FIG. 20, the voltage ripple level may be unexpectedly high or low during the ON period of the PWM pulse 4003. Even with the same PWM pulse width, the anode voltage varies during the PWM ON period, generating an unexpected luminance difference. To the contrary, when the PWM pulse width is constant, like a waveform 4062 in FIG. 14, the anode voltage applied during the pulse ON period is constant to obtain a constant luminance.

Figure 15:
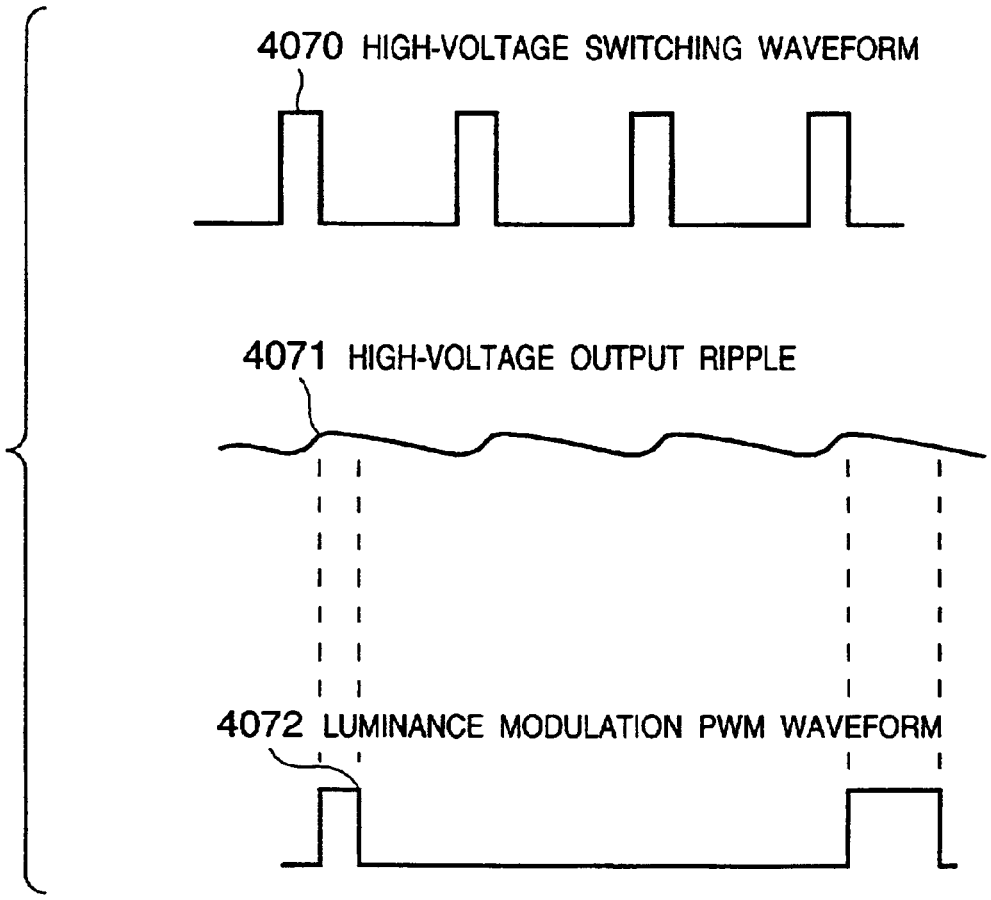
FIG. 15 is a waveform chart showing the pulse width modulation (PWM) pulse when the pulse width changes.
Figure 16:
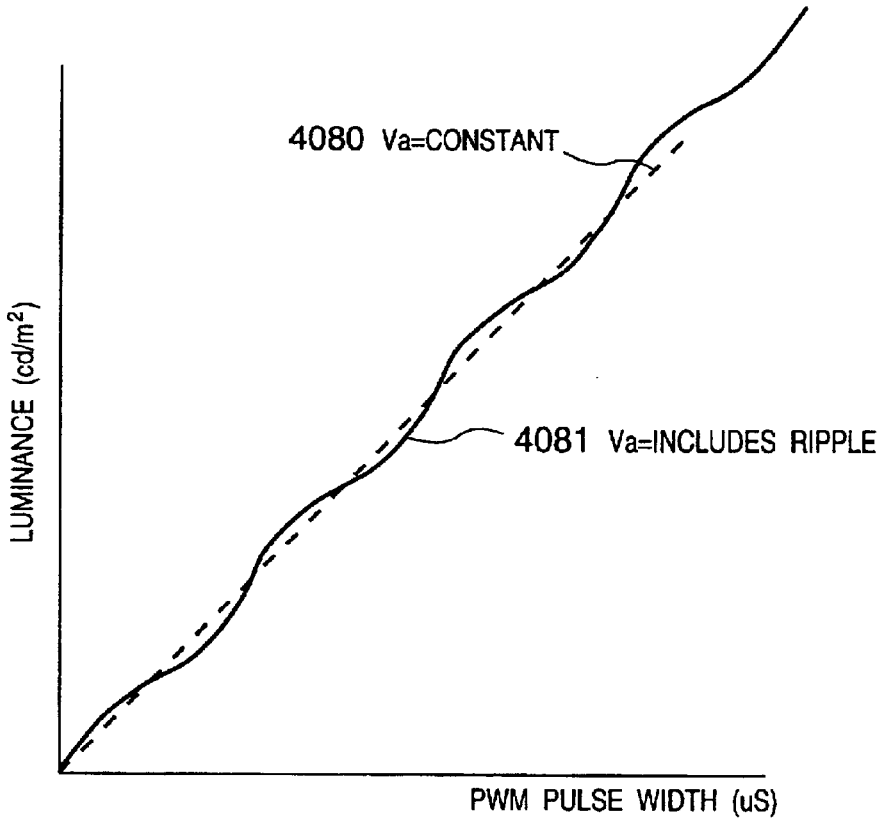
FIG. 16 is a graph showing the pulse width modulation (PWM) pulse width vs. luminance characteristic.
Figure 17:
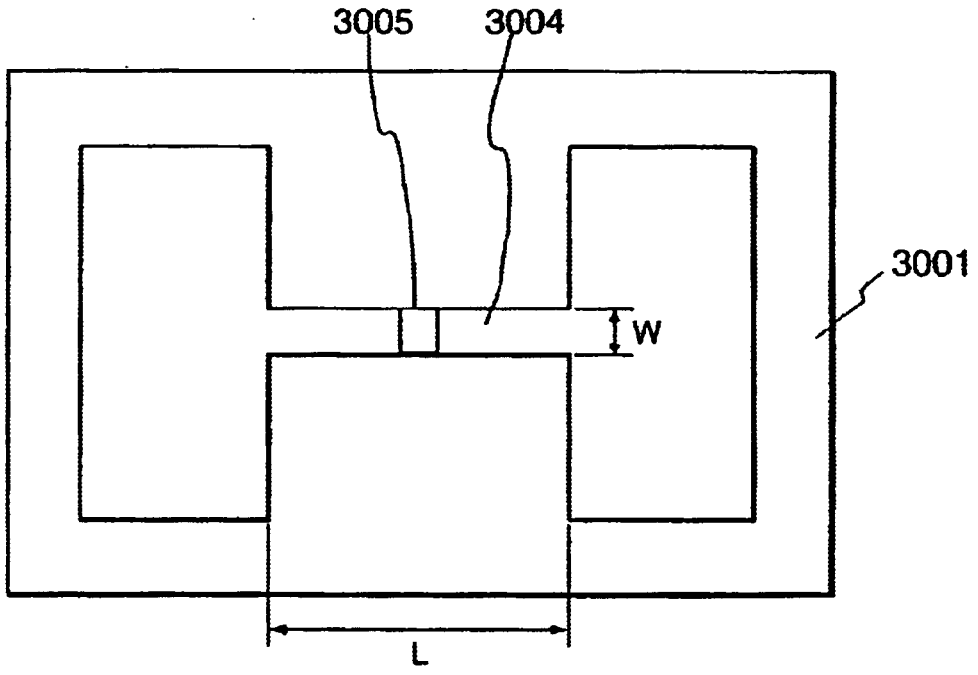
FIG. 17 is a plan view showing a Hartwell surface-conduction emission type electron-emitting device.
Figure 18:
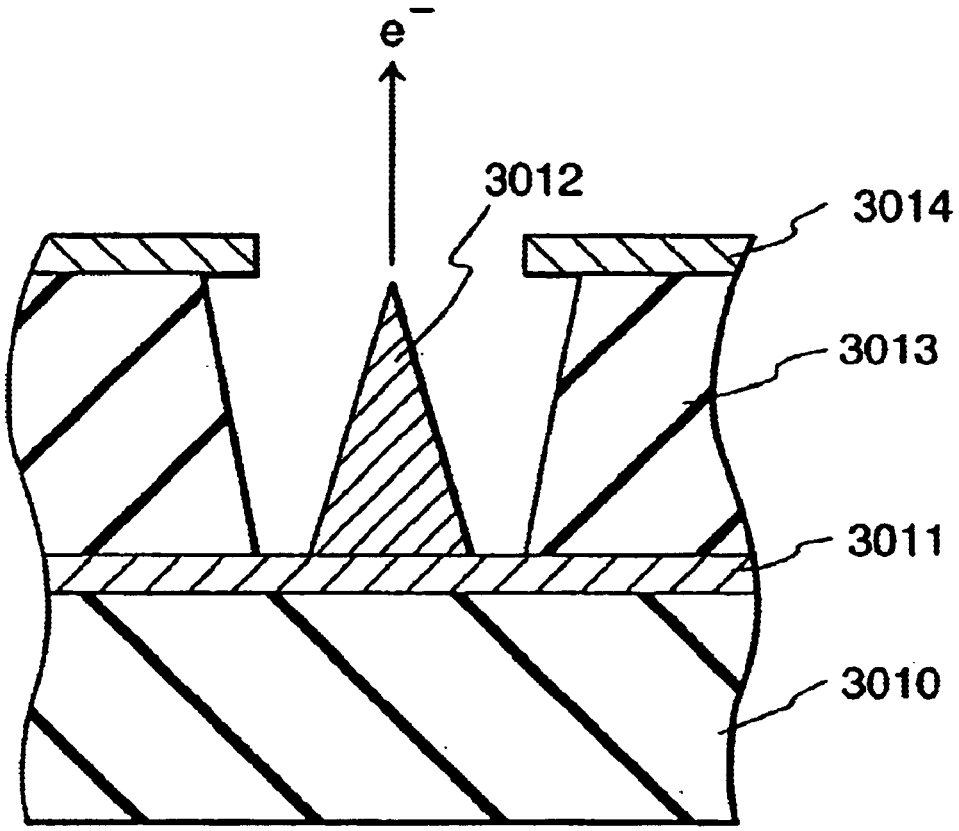
FIG. 18 is a sectional view showing a Spindt field emission type device.
Figure 19:
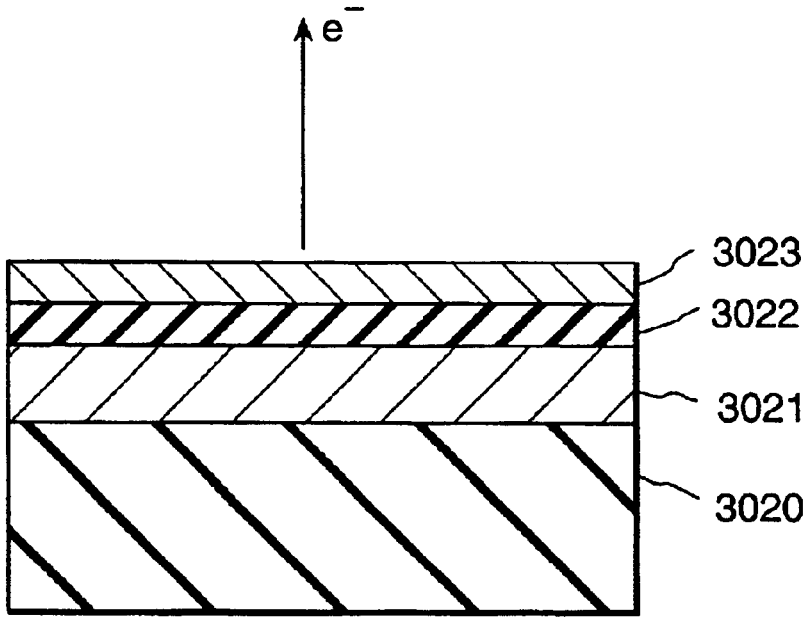
FIG. 19 is a sectional view showing an MIM (Metal/Insulator/Metal) type device.

Even when the PWM pulse width changes, like a waveform 4072 in FIG. 15, the voltage ripple decreases, like a ripple 4071 in FIG. 1, because of a high switching frequency of the high-voltage power source. Therefore, the PWM pulse width vs. luminance characteristic comes very close to a curve 4080 for Va=constant, and the gray level can be satisfactorily expressed, like a waveform 4081 in FIG. 16.

When the switching frequency synchronizes with a multiplied frequency, the voltage ripple decreases to reduce the influence on the luminance. It is considered that luminance variations can be reduced to an unnoticeable degree by increasing the switching frequency (two time or more) even when the switching frequency is not synchronized with a multiplied frequency. However, luminance variations cannot be completely eliminated. In practice, when the switching frequency is synchronized with a multiplied frequency, the luminance hardly varies, and the gray level can be satisfactorily expressed.

As described above, the switching frequency of the high-voltage power source is synchronized with the PWM frequency. The same effect as described above could be confirmed even if pulse width modulation was replaced with pulse height modulation in PHM.

[Third Embodiment]

The first embodiment has exemplified the arrangement in which the selection frequency of line-sequential scanning is made equal to the switching frequency of the high-voltage power source for supplying an accelerating potential. The second embodiment has exemplified the arrangement in which a natural number multiple of the selection frequency of line-sequential scanning is made equal to the switching frequency of the high-voltage power source.

In the third embodiment, letting t1 be the switching period of the high-voltage power source and t2 be one selection period of line-sequential scanning, t1>t2 holds. The third embodiment concerns an arrangement that satisfies a condition under which the above described value q*T/t1 becomes an arbitrary natural number n as a more preferable condition.

In the third embodiment, the selection frequency of line-sequential scanning is set to 15.75 kHz; the frame period, 1/60 sec; q, 1; and n, 200. At this time, 262.5 signals segmented by horizontal sync signals correspond to one frame. Of these signals, 240 signals are used for display.

Then, the switching frequency of the high-voltage power source is determined to 12 kHz. The second embodiment determines the switching frequency of the high-voltage power source to be four times the horizontal sync frequency. Similarly, the third embodiment obtains 200 times the frequency by the PLL based on the frame period. The obtained frequency is set as the switching frequency of the high-voltage power source.

These numerical values are merely examples which satisfy the above condition relation. For example, another condition under which the high-voltage power source can function most efficiently can be adopted within the range of the condition relation.

As described in each embodiment, the above-mentioned arrangement can suppress or expect the influence on a luminance output when the accelerating potential for accelerating electrons includes a ripple. In addition, evaluation upon actually looking the screen can be improved. Since these effects can be attained without eliminating any ripple, the capacitances of the high-voltage power source transformer and smoothing capacitor can be suppressed, thereby reducing the apparatus cost.

The present invention can realize a preferable electron-beam apparatus and image display apparatus.

As many apparently widely different embodiments of the present invention can be made without departing from the spirit and scope thereof, it is to be understood that the invention is not limited to the specific embodiments thereof as defined in the appended claims.

What is claimed is:

1. A drive circuit for line sequential driving a plurality of electron-emitting devices which are arranged in a matrix, the plurality of electron-emitting devices being driven by a matrix of wirings which includes a plurality of row wirings and a plurality of column wirings, wherein electrons emitted by said plurality of electron-emitting devices are accelerated by an acceleration potential, said drive circuit comprises a circuit for supplying a selection potential to a selected one of the plurality of row wirings which is selected by a sequential scanning of the plurality of row wirings, and a frequency of the sequential scanning is equal to a frequency of a ripple of the acceleration potential.

2. The drive circuit according to claim 1, wherein signals having a waveform based on input data are supplied to the plurality of column wirings.

3. A power source comprising a circuit arranged for supplying a potential to an acceleration electrode to accelerate electrons emitted by a plurality of electron-emitting devices which are driven by line sequential scanning via a matrix of wirings, wherein the potential includes a ripple, and a frequency of the ripple is equal to a scanning frequency of the line sequential scanning.

4. A drive circuit for line sequential driving a plurality of electron-emitting devices which are arranged in a matrix, the plurality of electron-emitting devices being driven by a matrix of wirings which includes a plurality of row wirings and a plurality of column wirings, wherein electrons emitted by said electron-emitting devices are accelerated by an acceleration potential, and said drive circuit comprises a circuit for supplying a selection potential to a selected one of the row wirings which is selected by a sequential scanning of the plurality of row wirings, and wherein a multiple of an integer of not less than 2 of a frequency of the sequential scanning is equal to a frequency of a ripple of the acceleration potential.

5. The drive circuit according to claim 4, wherein signals having a waveform based on input data are supplied to the plurality of column wirings.

6. A power source comprising a circuit arranged for supplying a potential to an acceleration electrode to accelerate electrons emitted by a plurality of electron-emitting devices which are driven by line sequential scanning via a matrix of wirings, wherein the potential includes a ripple, and a frequency of the ripple is equal to a multiple of an integer of not less than 2 of a scanning frequency of the line sequential scanning.

7. A power source comprising a circuit arranged for supplying a potential to an acceleration electrode to accelerate electrons emitted by a plurality of electron-emitting devices which are arranged in a matrix, wherein an image is formed by fluorescence upon reception of electrons emitted by the plurality of electron-emitting devices, the potential includes a ripple, and a frequency f1 of the ripple is defined by equation (1), $$f1=n/(q*T) \quad (1)$$

where q is any natural number in a range of 1 to 10, n is an arbitrary natural number, and T is one frame period of forming the image.

8. An image forming apparatus comprising:

a plurality of electron-emitting devices arranged in a matrix, the plurality of electron-emitting devices being driven by line sequential scanning using a matrix of wirings including a plurality of row wirings and a plurality of column wirings;

an acceleration electrode being supplied with an acceleration potential for accelerating electrons emitted by the plurality of electron-emitting devices; and a circuit, arranged for supplying a selection potential to a selected one of the plurality of row wirings which is selected by a line sequential scanning of the plurality of row wirings, wherein a frequency of the line sequential scanning is equal to a frequency of a ripple of the acceleration potential.

9. The apparatus according to claim 8, wherein signals having a waveform based on input data are supplied to the plurality of column wirings.

10. An image forming apparatus comprising:

a plurality of electron-emitting devices arranged in matrix, the plurality of electron-emitting devices being driven by line sequential scanning using a matrix of wirings including a plurality of row wirings and a plurality of column wirings;

an acceleration electrode being supplied with an acceleration potential for accelerating electrons emitted by the plurality of electron-emitting devices; and a circuit arranged for supplying a selection potential to a selected one of the plurality of row wirings which is selected by a sequential scanning of the plurality of row wirings, wherein a multiple of an integer of not less than 2 of a frequency of the sequential scanning is equal to a frequency of a ripple of the acceleration potential.

11. The apparatus according to claim 10, wherein signals having a waveform based on input data are supplied to the plurality of column wirings.

12. An image forming apparatus comprising:

a plurality of electron-emitting devices arranged in matrix, the plurality of electron-emitting devices being driven by line sequential scanning using a matrix of wirings including a plurality of row wirings and a plurality of column wirings;

an acceleration electrode being supplied with an acceleration potential for accelerating electrons emitted by the plurality of electron-emitting devices; and a fluorescent substance, arranged to form an image upon reception of electrons emitted by the electron-emitting devices, wherein frames of the image are formed sequentially, and each of the frames is formed by a sequential driving of the plurality of electron-emitting devices arranged in the matrix, and said acceleration potential includes a ripple, and wherein a frequency f1 of the ripple is defined by equation (1), $$f1=n/(q*T) \quad (1)$$

where q is at least any natural number in a range of 1 to 10, n is an arbitrary natural number, and T is one frame period.

* * * * *

UNITED STATES PATENT AND TRADEMARK OFFICE

CERTIFICATE OF CORRECTION

PATENT NO. : 6,809,480 B2
DATED : October 26, 2004
INVENTOR(S) : Kenji Shino

It is certified that error appears in the above-identified patent and that said Letters Patent is hereby corrected as shown below:

Title page,
Item [75], Inventors, "Kenji Shino, Kanagawa-ken (JP)" should read -- Kenjo Shino, Yokohama (JP) --.

Drawings,
Sheet 8, Figure 8, "DITECTION PULSE" should read -- DETECTION PULSE --.

Column 1,
Line 27, "Phys.," should read -- Phys.", --.

Column 4,
Line 38, "devices" should read -- device --.

Column 6,
Line 30, "device" should read -- device --.

Column 8,
Line 24, "allows" should read -- allowed --;
Line 45, "preferable" should read -- preferably --; and
Line 53, "falls" should read -- fall --.

Column 10,
Line 48, "covering" should read -- converting --.

Column 16,
Line 7, "outputs" should read -- output --.

Column 17,
Line 3, "time" should read -- times --;
Line 37, "to" should read -- to be --; and

UNITED STATES PATENT AND TRADEMARK OFFICE

CERTIFICATE OF CORRECTION

PATENT NO. : 6,809,480 B2
DATED : October 26, 2004
INVENTOR(S) : Kenji Shino

It is certified that error appears in the above-identified patent and that said Letters Patent is hereby corrected as shown below:

Column 17 (cont'd),
Line 53, "looking" should read -- looking at --.

Signed and Sealed this

Seventeenth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,809,480 B2
DATED : October 26, 2004
INVENTOR(S) : Kenji Shino

It is certified that error appears in the above-identified patent and that said Letters Patent is hereby corrected as shown below:

Title page,
Item [75], Inventors, "Kenji Shino, Kanagawa-ken (JP)" should read -- Kenji Shino, Yokohama (JP) --.

Drawings,
Sheet 8, Figure 8, "DITECTION PULSE" should read -- DETECTION PULSE --.

Column 1,
Line 27, "Phys.," should read -- Phys.", --.

Column 4,
Line 38, "devices" should read -- device --.

Column 6,
Line 30, "devices" should read -- device --.

Column 8,
Line 24, "allows" should read -- allowed --;
Line 45, "preferable" should read -- preferably --; and
Line 53, "falls" should read -- fall --.

Column 10,
Line 48, "covering" should read -- converting --.

Column 16,
Line 7, "outputs" should read -- output --.

UNITED STATES PATENT AND TRADEMARK OFFICE

CERTIFICATE OF CORRECTION

PATENT NO. : 6,809,480 B2
DATED : October 26, 2004
INVENTOR(S) : Kenji Shino

It is certified that error appears in the above-identified patent and that said Letters Patent is hereby corrected as shown below:

Column 17,
Line 3, “time” should read -- times --;
Line 37, “to” should read -- to be --; and
Line 53, “looking” should read -- looking at --.

This certificate supersedes Certificate of Correction issued May 17, 2005.

Signed and Sealed this

Twenty-first Day of February, 2006

JON W. DUDAS
*Director of the United States Patent and Trademark Office*